US005372448A

United States Patent [19]

Gilb

[11] Patent Number: 5,372,448

[45] Date of Patent: Dec. 13, 1994

[54] RIGID INTERSECTION CONNECTION

[75] Inventor: Tyrell T. Gilb, Berkeley, Calif.

[73] Assignee: Simpson Strong-Tie Company, Inc., San Leandro, Calif.

[21] Appl. No.: 229,451

[22] Filed: Apr. 18, 1994

Related U.S. Application Data

[62] Division of Ser. No. 119,611, Sep. 10, 1993, Pat. No. 5,328,287, which is a division of Ser. No. 855,194, Mar. 20, 1992, Pat. No. 5,259,685.

[51] Int. Cl.[5] ..... E04B 1/00

[52] U.S. Cl. ..... 403/231; 403/171; 403/170; 52/280

[58] Field of Search ..... 403/170, 171, 176, 403, 403/232.1, 231, 217, 205, 230; 52/280, 281; 248/300, 220.1, 228

[56] References Cited

U.S. PATENT DOCUMENTS

| | | | |
|---|---|---|---|
| 115,195 | 5/1871 | Grove . | |
| 261,919 | 8/1882 | Gibbons . | |
| 682,621 | 9/1901 | Humphrey . | |
| 891,604 | 6/1908 | Diamond . | |
| 952,506 | 3/1910 | Bumpus . | |
| 1,758,955 | 5/1930 | Lovejoy | 403/205 |
| 2,037,736 | 4/1936 | Payne et al. | 403/231 X |
| 2,168,911 | 8/1939 | Meyer | 24/81 |
| 2,321,221 | 6/1943 | Linehan | 403/230 |
| 2,874,708 | 2/1954 | Daus | 403/176 |
| 3,085,841 | 4/1963 | Snyder | 312/140 |
| 3,572,787 | 3/1971 | Timmerman | 403/230 |
| 4,072,433 | 2/1978 | Veyhl | 403/176 |
| 4,076,431 | 2/1978 | Burvall | 403/171 |
| 4,093,167 | 6/1978 | Rocklyn | 403/231 X |
| 4,297,048 | 10/1981 | Jureit et al. | 403/231 X |
| 4,318,628 | 3/1982 | Mancini | 403/231 |
| 4,688,358 | 8/1987 | Madray | 403/171 |
| 4,758,111 | 7/1988 | Vitta | 403/176 |
| 4,812,075 | 3/1989 | Lavin, Sr. | 403/403 |
| 4,885,883 | 12/1989 | Wright | 52/280 |
| 4,910,939 | 3/1990 | Cavanagh | 403/171 |
| 5,160,211 | 11/1992 | Gilb . | |
| 5,259,685 | 11/1993 | Gilb | 403/170 |

FOREIGN PATENT DOCUMENTS

| | | | |
|---|---|---|---|
| 1286872 | 1/1962 | France | 403/176 |
| 1295797 | 5/1962 | France | 403/171 |
| 742617 | 12/1955 | United Kingdom | 403/176 |
| 744294 | 2/1956 | United Kingdom | 403/171 |

*Primary Examiner*—Randolph A. Reese
*Assistant Examiner*—Anthony Knight
*Attorney, Agent, or Firm*—James R. Cypher

[57] ABSTRACT

A rigid intersection connection including three intersecting elongated wood structural members and a rigid connector made from a single sheet metal blank which requires no welding. The rigid connector includes a pair of angular members joined in angular relationship and joined at a common outer edge. The rigid connector more specifically includes structure for engaging two sides of one of the elongated wood structural members and three sides of two of the elongated wood structural members. The disclosure includes a log holder, a table, a bunk bed, and a greenhouse or garden structure as examples of structures which can be readily constructed from the rigid intersection connections.

1 Claim, 23 Drawing Sheets

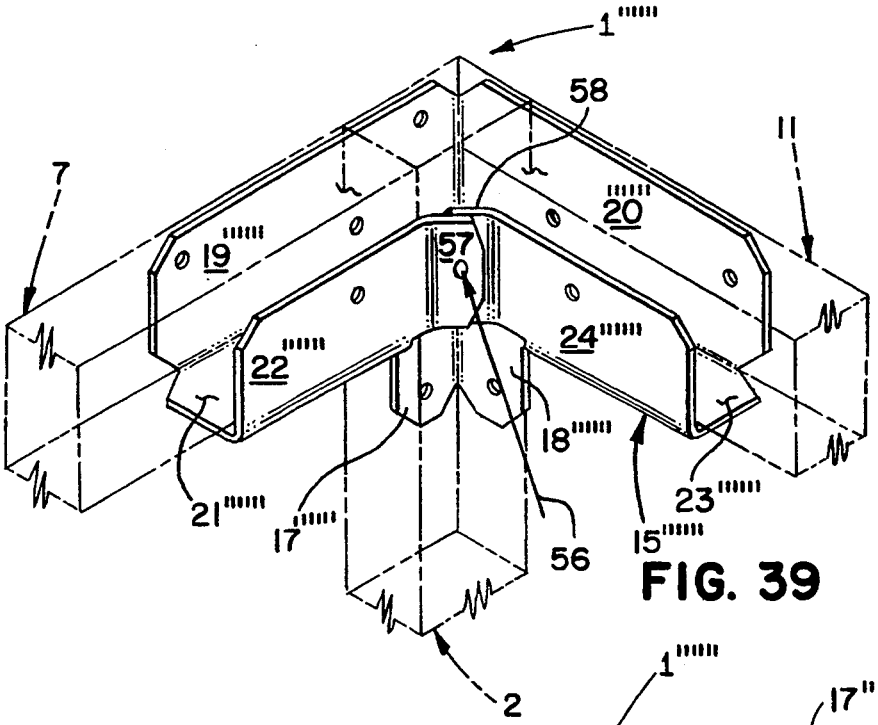
FIG. 39
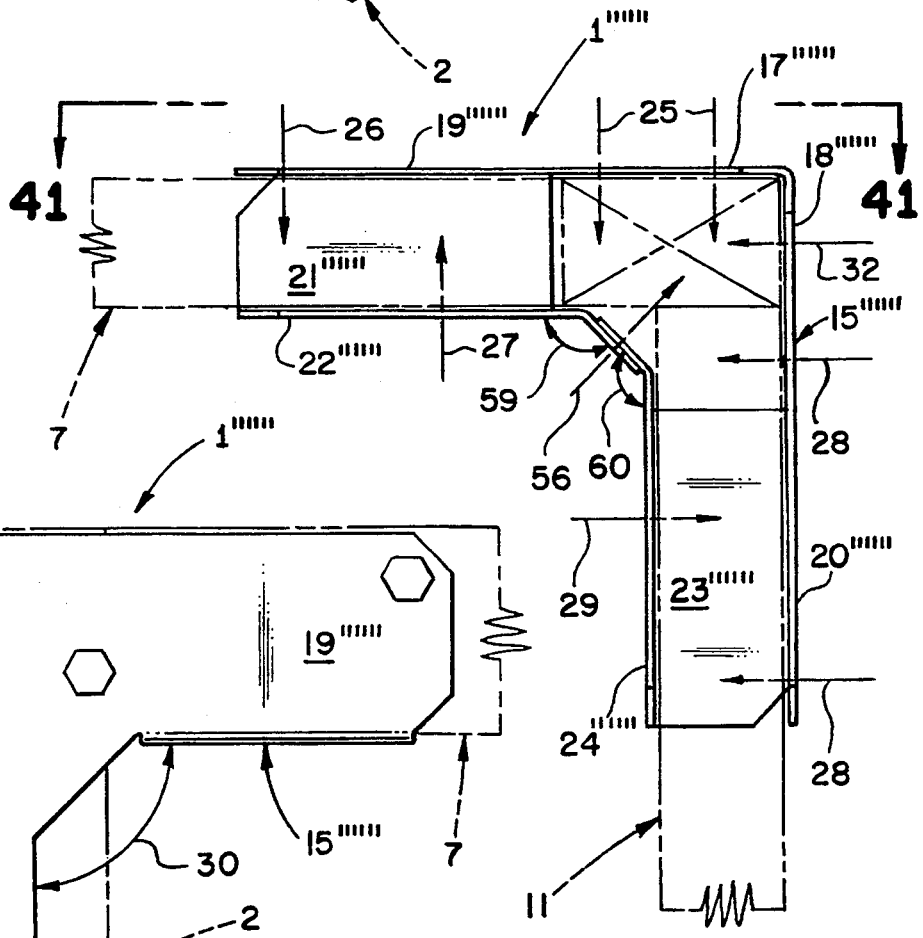
FIG. 41
FIG. 40

RIGID INTERSECTION CONNECTION

This application is a division of application Ser. No. 08/119,611 filed Sep. 10, 1993 which was allowed Jan. 12, 1994 now U.S. Pat. No. 5,328,287; which was itself a division of application Ser. No. 07/855,194 filed Mar. 20, 1992 which is now U.S. Patent 5,259,685 granted November 9, 1993.

BACKGROUND

This invention relates to a rigid intersection connection including a rigid sheet metal one piece connector for joining three intersecting wood elongated members in a rigid embrace.

Rigid intersection connections are common in metal structures, but are seldom used in wood frame construction because of the lack of a suitable metal connector.

Cast iron connectors have been used, but they are heavy, expensive, and difficult to work with and have not found use in today's high cost labor environment.

Attempts have been made in the past to provide connectors for rigidly joining two intersecting members, but these connectors have proven difficult to work with in joining three intersecting elongated wood members.

Several connectors have been created to join intersecting panels, but these connectors have not been adaptable for joining intersecting elongated wood members.

Molded plastic connectors which encapsulate the ends of intersecting elongated wood members have been taught, but these connectors are expensive, difficult to manufacture and install and have not found general acceptance in the building trades.

SUMMARY OF THE INVENTION

The present invention is a rigid intersection connection as opposed to a pin or hinge connection in a structure formed from three intersecting elongated wood members and joined by a rigid connector made from a single sheet of sheet metal which requires no welding.

The rigid intersection connection of the present invention enables furniture manufacturers and architects and engineers to construct articles and structures from a plurality of rectangles rather than being limited to a plurality of triangles.

An object of the present invention is to provide a rigid connector which will join three intersecting elongated wood members of varying dimensional cross section and at varying intersecting angles.

A further object is to provide a rigid connector that can be made from a single sheet metal blank yet used in various types of intersection connections by making a few simple bends in the metal.

Another object is to provide a rigid connector which can be simply modified to provide varying degrees of rigidity or to more efficiently accommodate intersecting elongated structural members of different cross sectional dimensions.

Still another object of the present invention is to provide a rigid intersection connection and rigid connector which can be used in a wide variety of furniture articles and building structures.

The use of at least eight rigid connectors, one at each corner of a cube structure, results in a rigidity of the structure which is similar to that achieved in triangular construction. Applicant has empirically proven that a synergistic relationship occurs between the eight rigid connectors in the cube with a cumulative rigid effect culminating in a rigidity of the structure which is greater than the sum of the individual rigid connectors.

The use of the rigid intersecting connections of the present invention eliminates the need for shear walls in building structures and cross braces in furniture structures.

BRIEF DESCRIPTION OF THE DRAWINGS

FIG. 39 is a perspective view of a rigid intersection connection of the present invention constructed with a fourth modified, second series rigid connector.

FIG. 40 is a top plan view of the rigid intersection connection constructed with the fourth modified, second series rigid connector illustrated in FIG. 39.

FIG. 41 is a side view of the rigid intersection connection illustrated in FIG. 40 and taken generally along line 41—41.

DESCRIPTION OF THE PREFERRED EMBODIMENT

Figure 1:
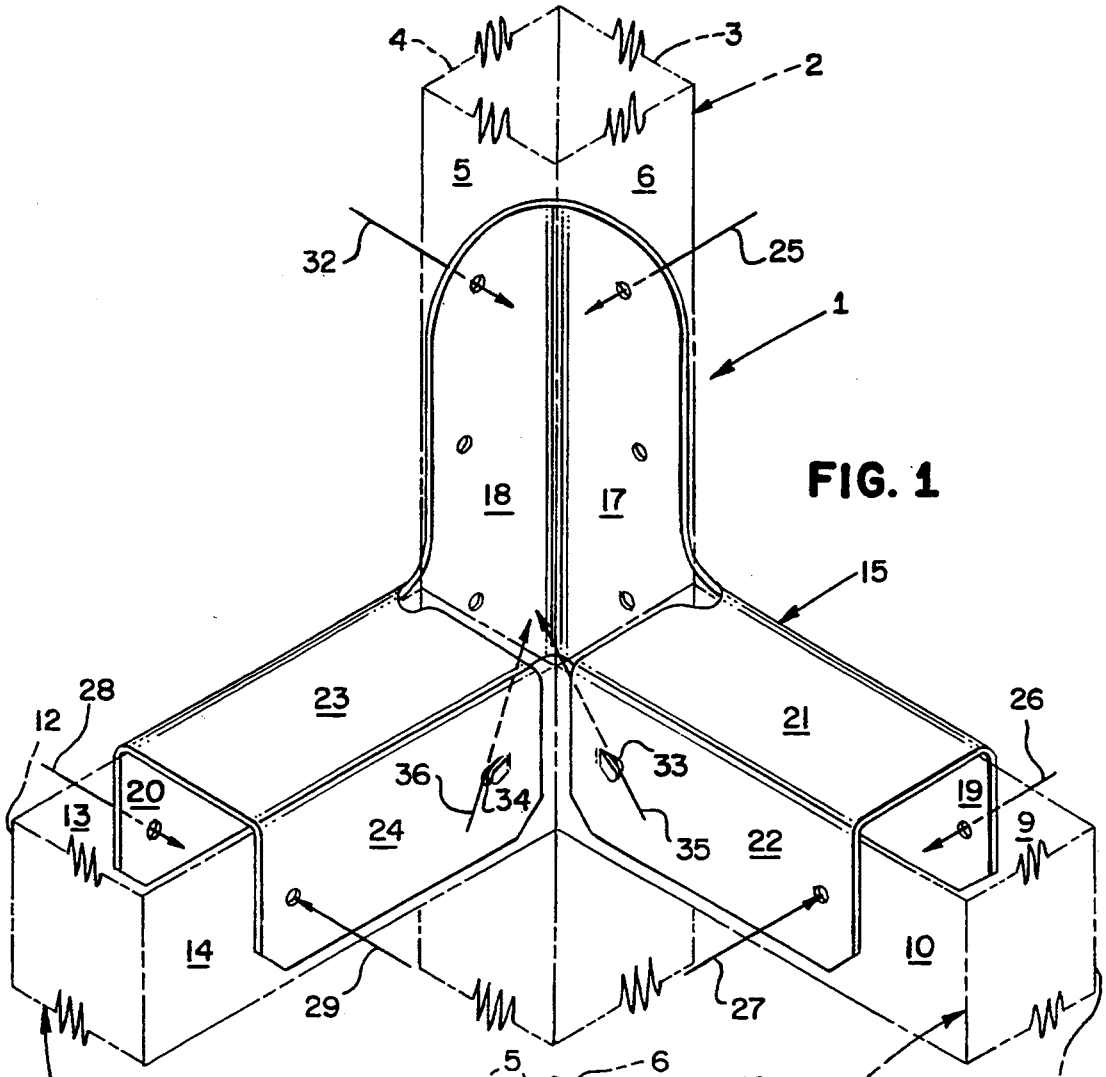
FIG. 1 is a perspective view of a rigid intersection connection of the present invention illustrating a second series rigid connector.

Referring to the drawings and in particular FIGS. 1, 2, 17 18, 25, 28 and 32, the rigid intersection connection 1, 1′, 1″, 1‴, 1⁗, 1′′′′′, and 1′′′′′′ of the present invention as shown in the structures of FIGS. 3, 23, 24 and 36 include a first elongated wood X structural member 2 having first, second, third, and fourth sides 3, 4, 5, and 6; a first elongated wood Y structural member 7 intersecting the elongated wood X structural member 2 and having first, seat and second sides 8, 9 and 10; a first elongated wood Z structural member 11 intersecting the elongated wood X and Y structural members 2 and 7 and having first, seat and second sides 12, 13, and 14; and a first rigid connector 15 constructed from a single sheet of sheet metal 16 configured for holding the intersecting elongated wood X, Y, and Z structural members 2, 7 and 11 in a rigid embrace.

The first rigid connector 15 includes: an XY support side member 17 dimensioned for registration with a portion of the elongated wood X structural member 2; an XZ support side member 18 integrally connected to the XY support side member 17 along a substantial portion thereof and dimensioned for registration with a portion of the elongated wood X structural member; a YX side member 19 integrally connected to the XY support side member 17 and dimensioned for registration with a portion of the first side 8 of the elongated wood Y structural member 7; a ZX side member 20 integrally connected to the XZ support side member 18 and dimensioned for registration with a portion of the first side 12 of the elongated wood Z structural member 11; a Y seat member 21 integrally connected to the YX side member 19 and dimensioned for registration with a portion of the seat side 9 of the elongated wood Y structural member 7; a Y side member 22 integrally connected to the Y seat member 21 and dimensioned for registration with a portion of the second side 10 of the elongated wood Y structural member 7; a Z seat member 23 integrally connected to the ZX side member 20 and dimensioned for registration with a portion of the seat side 13 of the elongated wood Z structural member 11; and a Z side member 24 integrally connected to the Z seat member 23 and dimensioned for registration with a portion of the second side 14 of the elongated wood Z structural member 11.

The rigid connectors are connected to the elongated wood structural members as shown in the drawings by first fastener means 25 attaching the XY support side member 17 to the first side of the elongated wood X structural member; second fastener means 26 attaching the YX side member 19 to the first side 8 of the elongated wood Y structural member 7; third fastener means 27 attaching the Y side member 22 to the second side 10 of the elongated wood Y structural member 7; fourth fastener means 28 attaching the ZX side member 20 to the first side 12 of the elongated wood Z structural member 11; and fifth fastener means 29 attaching the Z side member 24 to the second side 14 of the elongated wood Z structural member 11.

This application describes three basic rigid connectors which may be constructed from the same sheet metal blank 16. These rigid connectors are divided into three series 15', 15, and 15'' which in turn have several modifications.

First Series Rigid Connector

Figure 22:
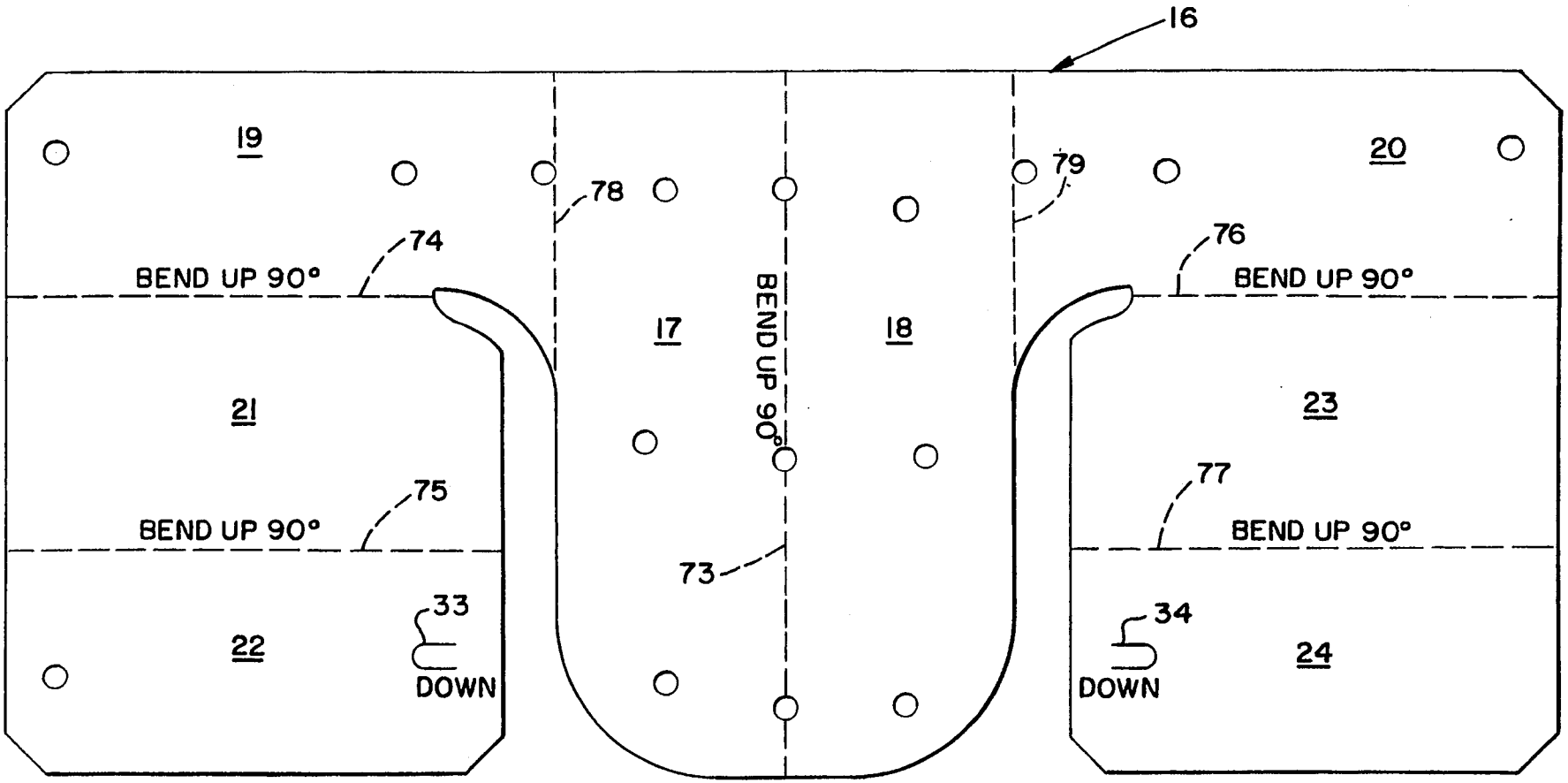
FIG. 22 is a plan view of the sheet metal blank from which the first series rigid connector illustrated in FIGS. 18–21 may be constructed as well as the second series rigid connector illustrated in FIGS. 1 and 2 as well as the third series rigid connector illustrated in FIG. 17.

The first series of rigid connectors 15' are illustrated in FIGS. 18–21 and are constructed from the blank 16 illustrated in FIG. 22. The first series rigid connectors 15' are used in the greenhouse structure 69 illustrated in FIGS. 3–14, the bench structure 61 illustrated in FIG. 23, and the bunk bed furniture structure 68 illustrated in FIGS. 36–38.

The first series rigid connection 1' is characterized by a structure in which the first elongated wood Y and Z structural members 7 and 11 are in general linear alignment and the XY and XZ support side members 17' and 18' of the first rigid connector 15' are in substantially the same plane.

The parts of the first series rigid connector 15' which are identical to the second series rigid connector 15 are designated by a single prime mark (') and the description is not repeated.

Third series Rigid connector

Figures 15, 16, 17:
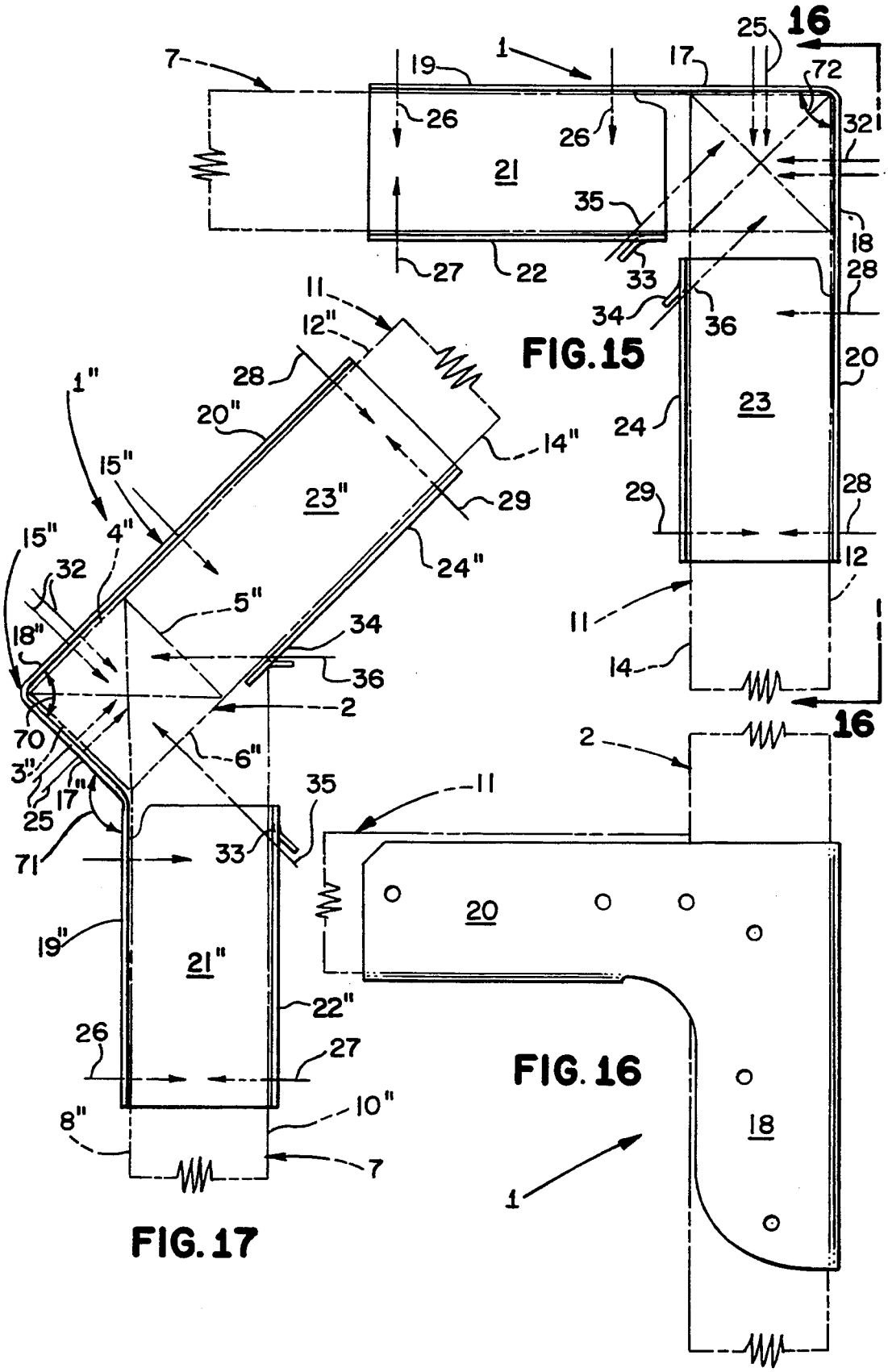
FIG. 15 is a top plan view of the second series rigid connector illustrated in FIGS. 1 and 2 and taken generally along line 15—15 in FIG. 3.
FIG. 16 is a side elevation view of the second series rigid connector illustrated in FIG. 15 and taken generally along line 16—16.
FIG. 17 is a side view of a third series rigid connector of the present invention taken along line 17—17 of FIG. 3.
Figure 18:
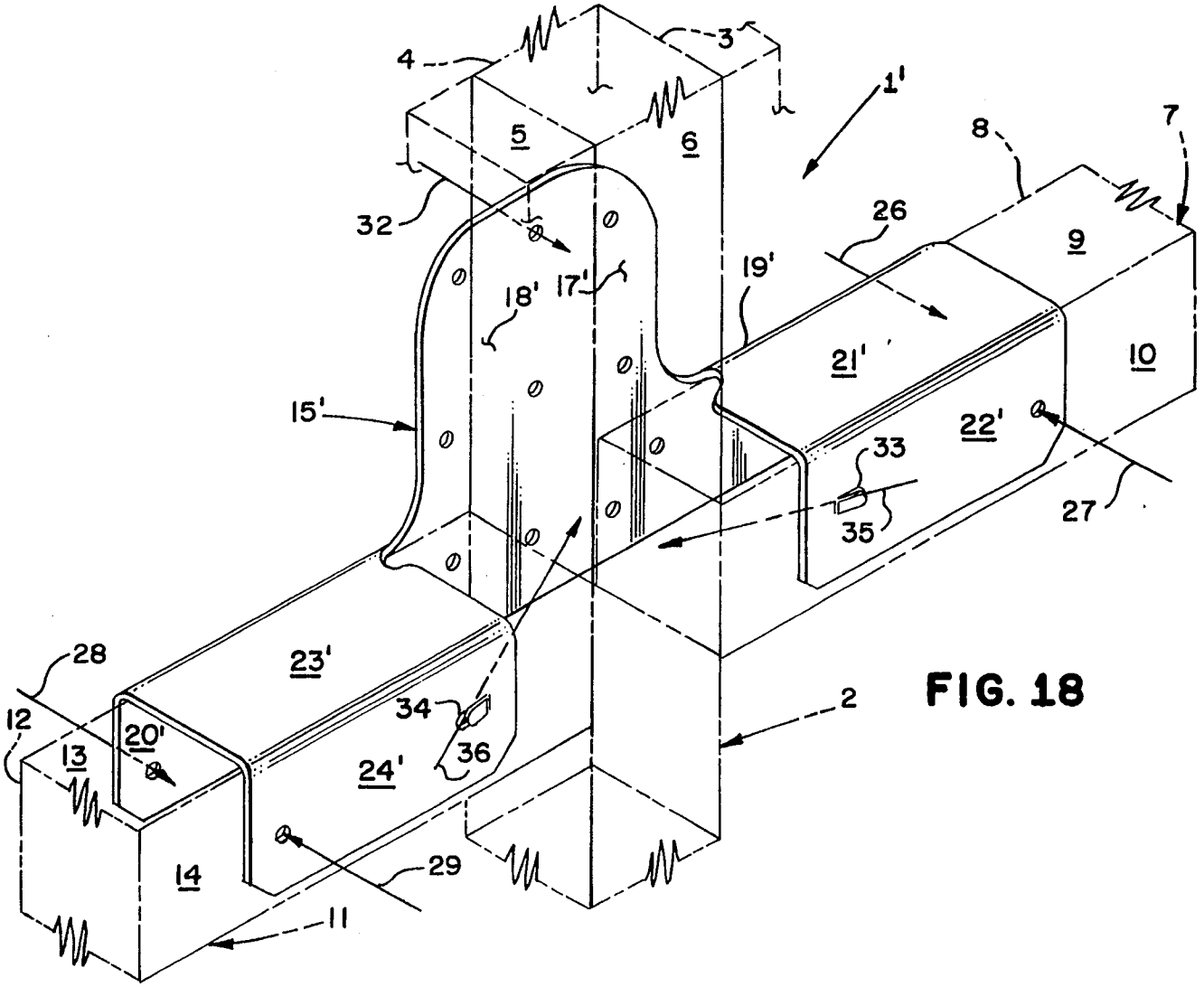
FIG. 18 is a perspective view of a first series rigid connector of the present invention.
Figures 19, 20, 21:
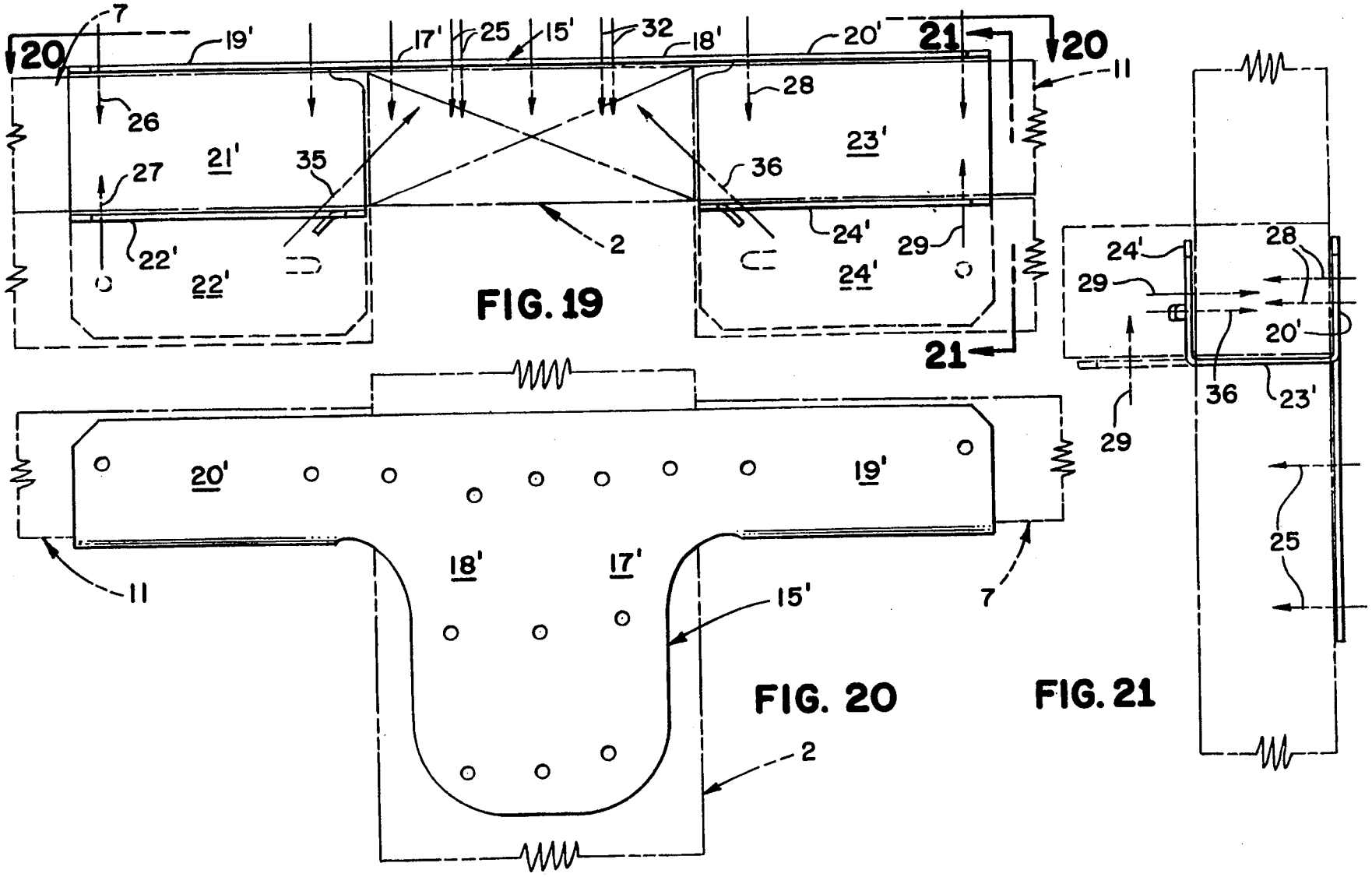
FIG. 19 is a top plan view of a first series rigid connector with portions in dashed line and folded down 90° to illustrate the construction.
FIG. 20 is a side view of a first series rigid connector taken generally along line 20–20 in FIG. 19.
FIG. 21 is a cross sectional view of the first series rigid connector illustrated in FIG. 19 taken generally along line 21—21.

The third series of rigid connectors 15'' are illustrated in FIG. 17 and are constructed from the blank 16 illustrated in FIG. 22. The third series rigid connectors 15'' are used in the greenhouse structure 69 illustrated in FIGS. 3–14.

The third series rigid connection 1'' is characterized by a structure in which the XY, and XZ support side members 17'' and 18'' of the first rigid connector 15'' are disposed at an angle 70 and the YX side member 19'' and the XY support side member 17'' of the first rigid connector 15'' are disposed at an angle 71.

The parts of the third series rigid connector 15'' which are identical to the second series rigid connector 15 are designated by a double prime mark (") and the description is not repeated.

Second Series Rigid connector

Figure 25:
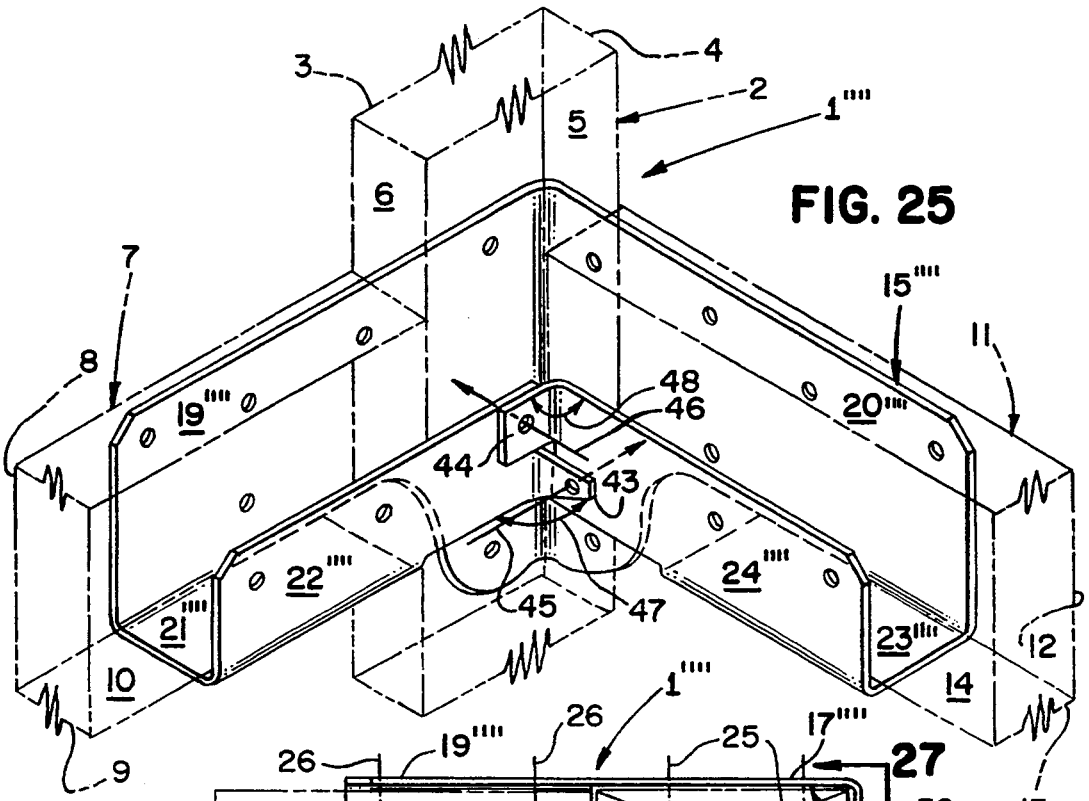
FIG. 25 is a perspective view of a rigid intersection connection of the present invention using a second modified, second series rigid connector.
Figure 26:
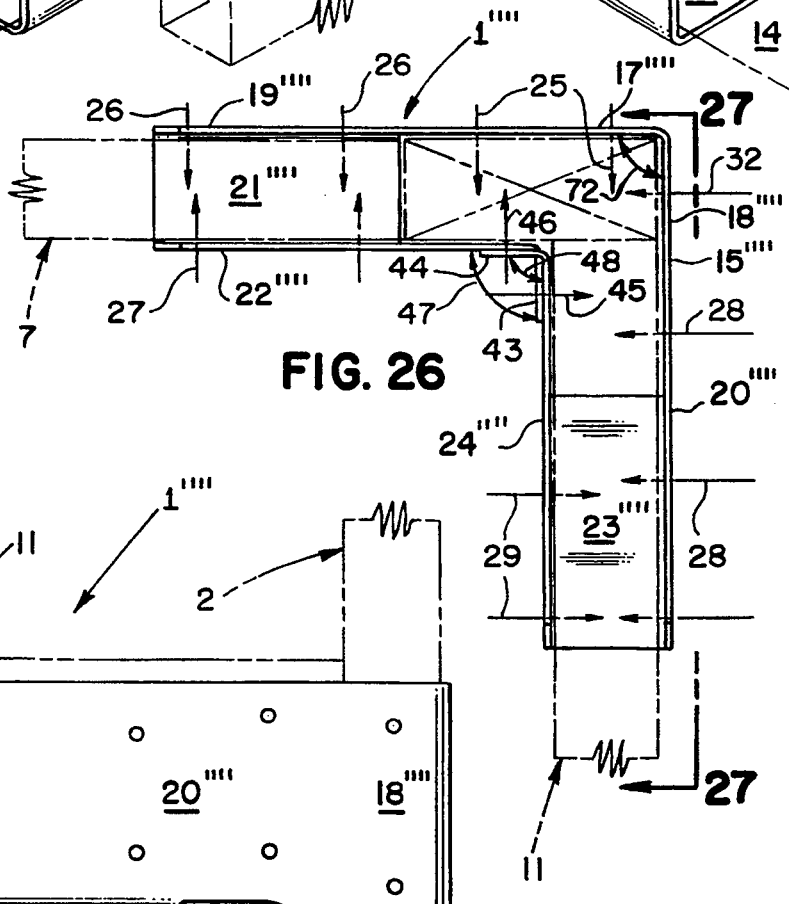
FIG. 26 is a top plan view of second modified, second series rigid connector illustrated in FIG. 25.
Figure 27:
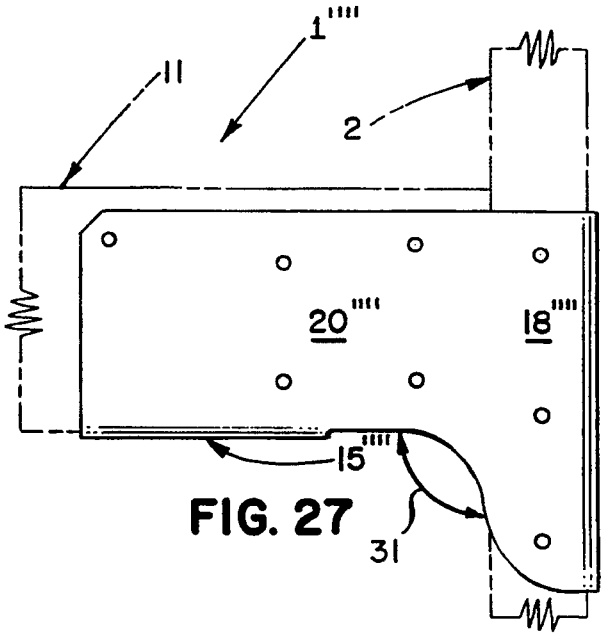
FIG. 27 is a side view of a second modified, second series rigid connector illustrated in FIG. 26 taken generally along line 27—27.
Figure 28:
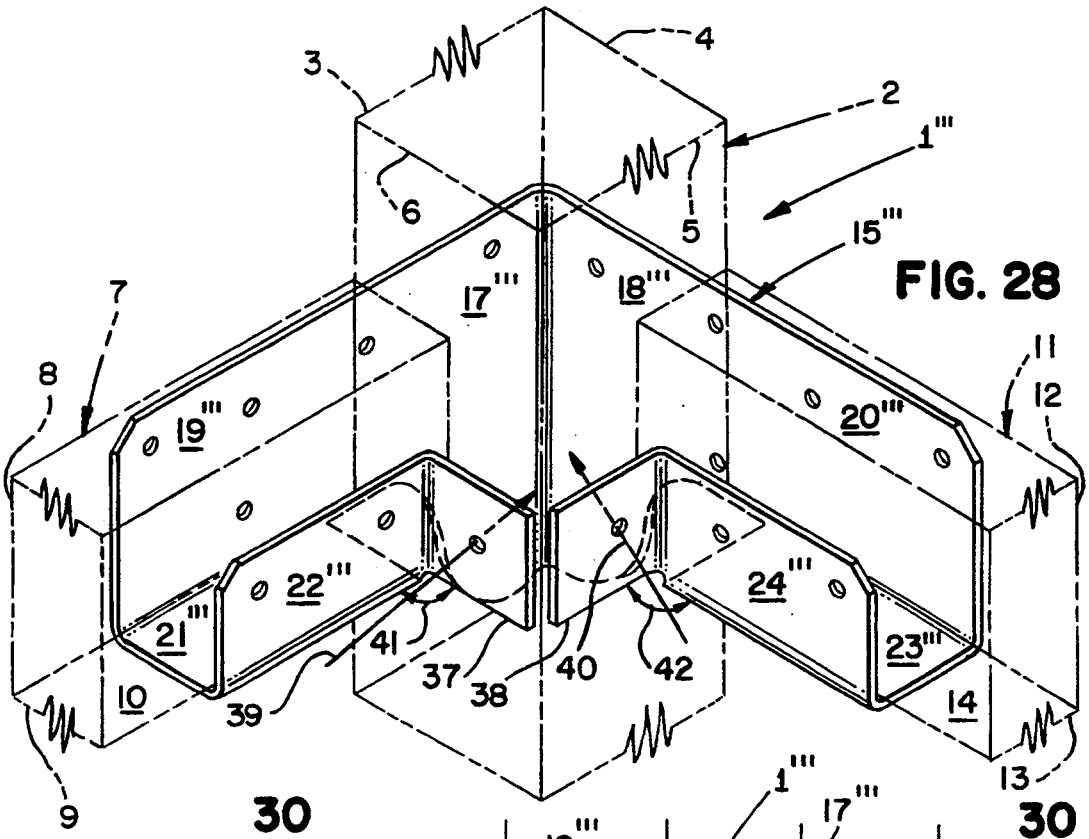
FIG. 28 is a perspective view of a rigid intersection connection illustrating a first modified, second series rigid connector of the present invention.
Figure 29:
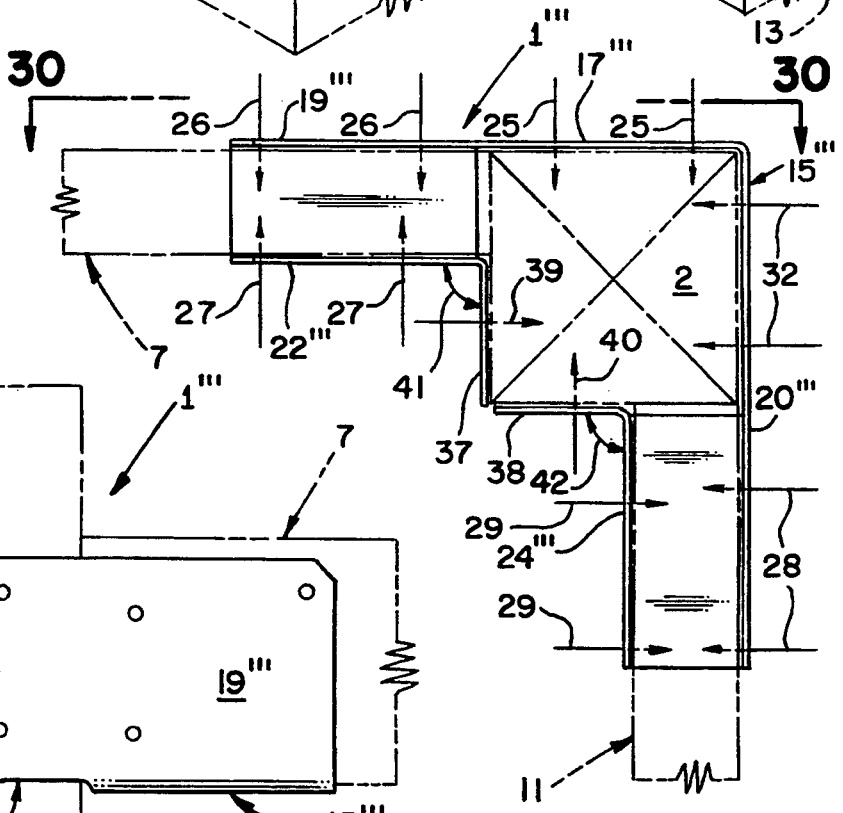
FIG. 29 is a top plan view of the rigid intersection connection illustrated in FIG. 28.
Figure 30:
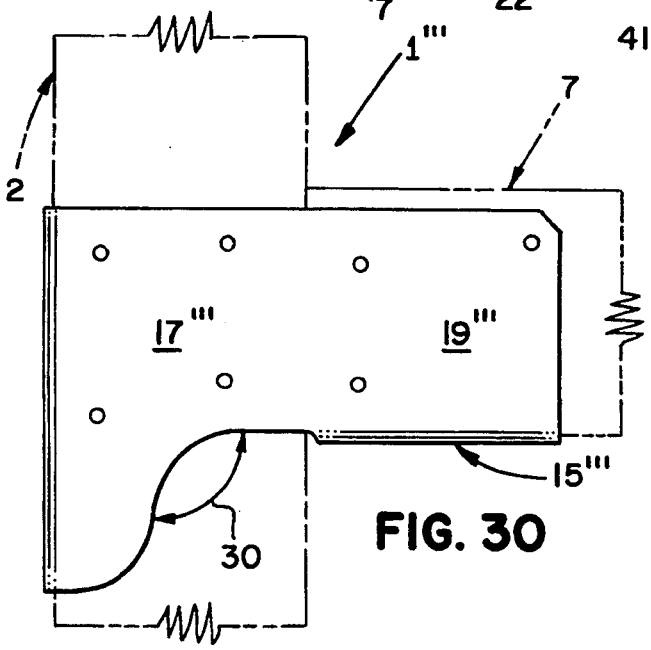
FIG. 30 is a side elevation view of the rigid intersection connection illustrated in FIG. 29.
Figure 32:
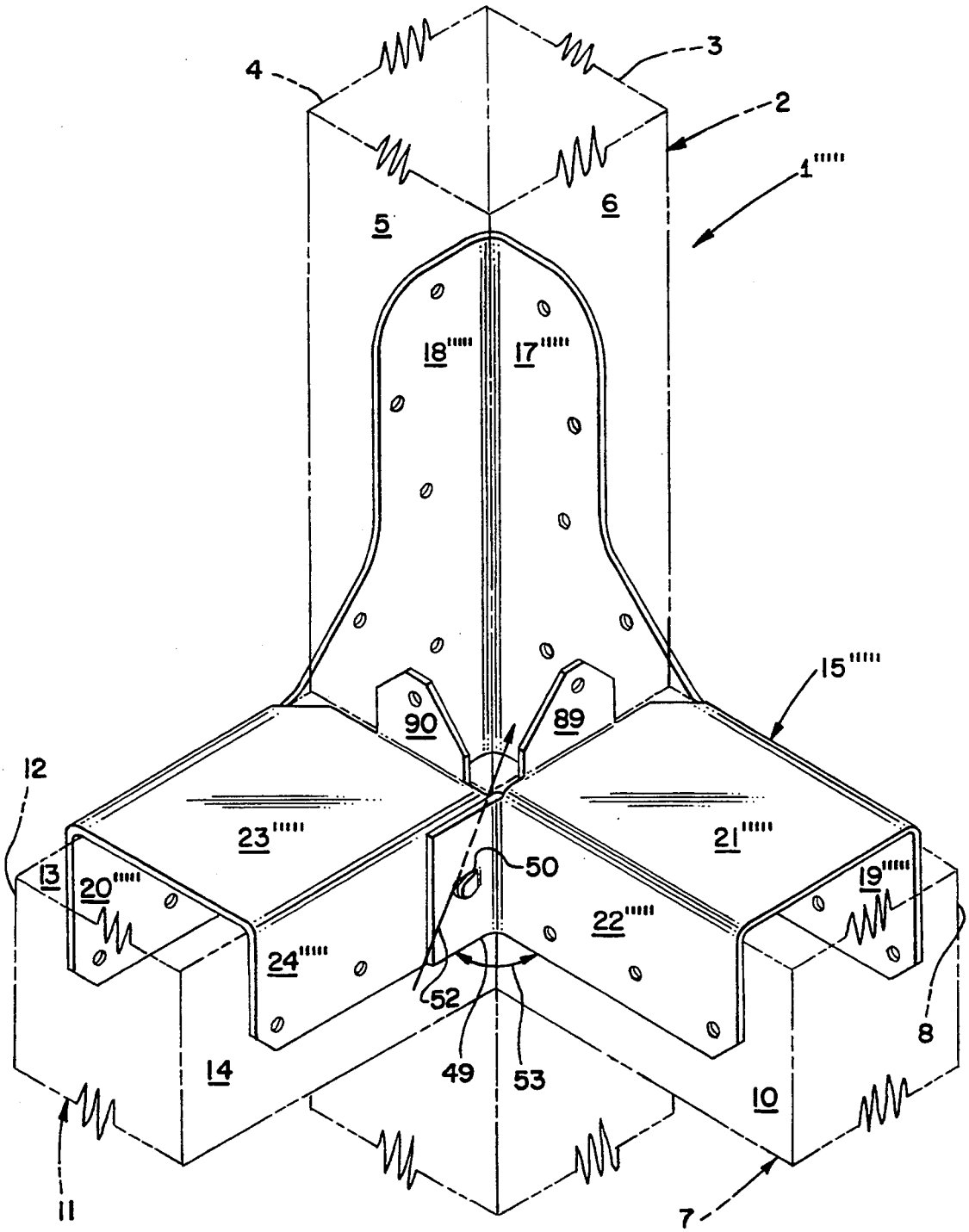
FIG. 32 is a perspective view of a rigid intersection connection of the present invention constructed with a third modified, second series rigid corrector.
Figure 33:
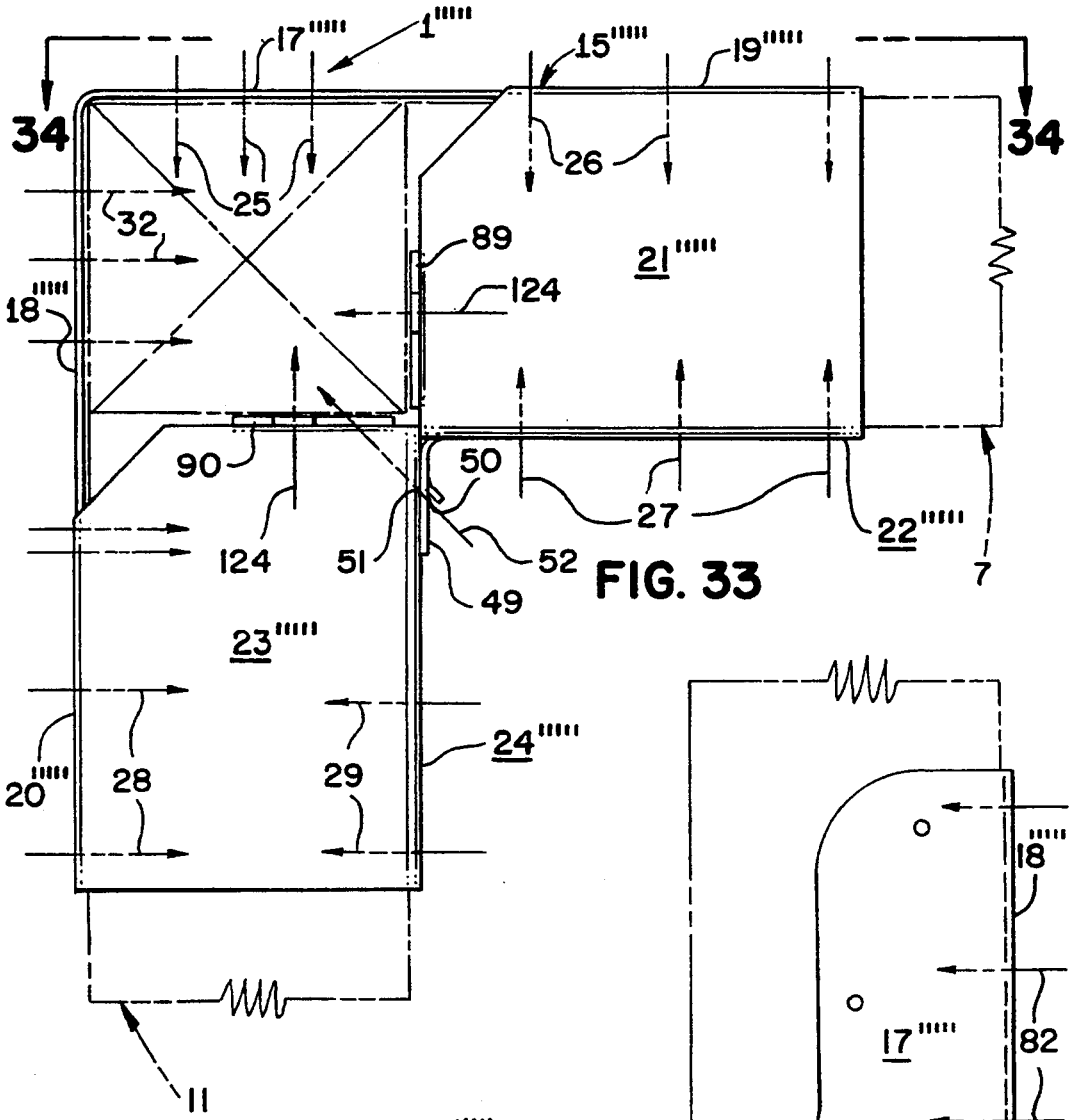
FIG. 33 is a top plan view of the third modified, second series rigid connector illustrated in FIG. 32.
Figure 34:
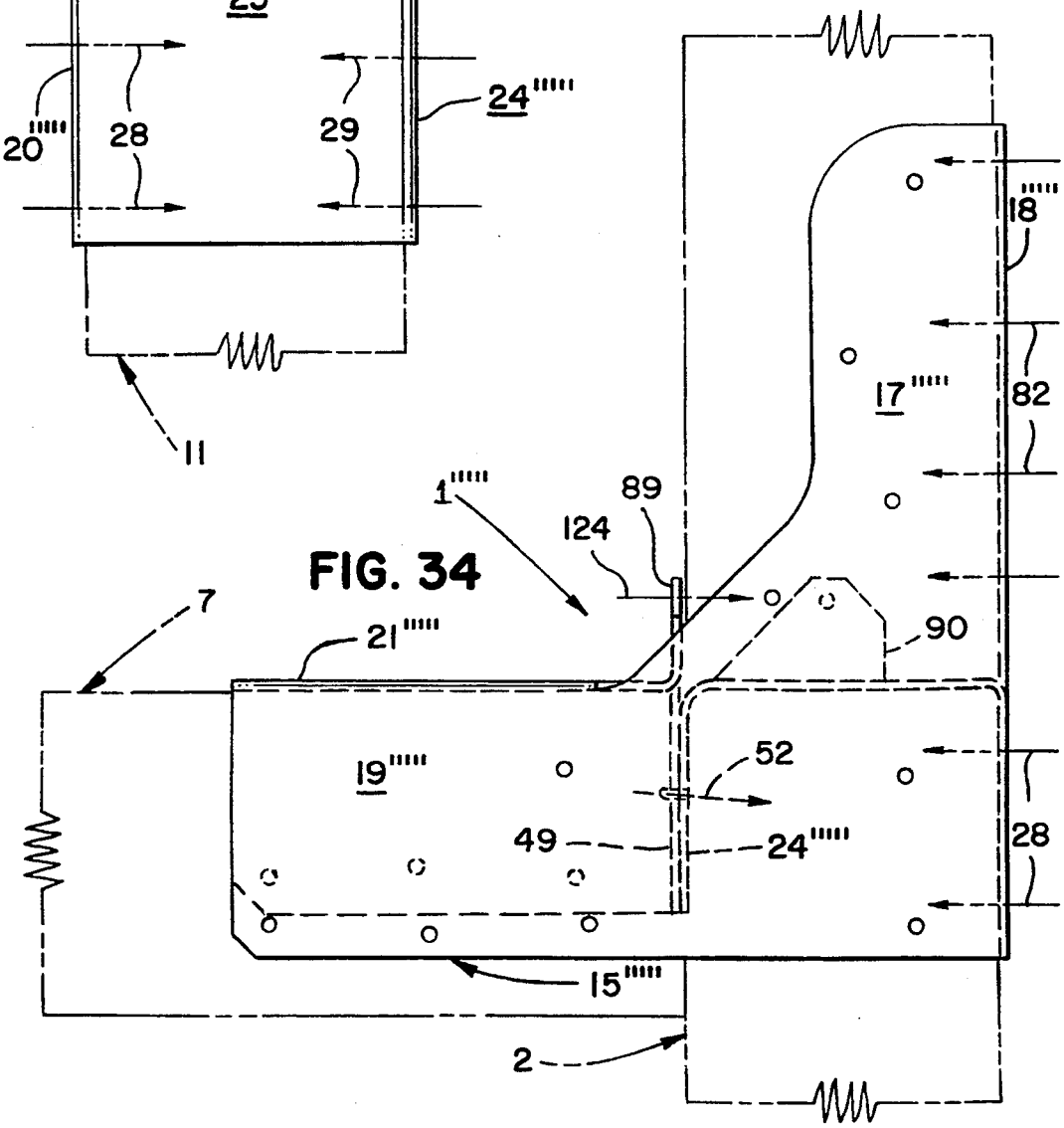
FIG. 34 is a side view of the third modified, second series rigid connector illustrated in FIG. 33 taken along line 34—34.

The second series of rigid connectors 15 are illustrated in FIGS. 1, 2, 15 and 16 and are constructed from the blank 16 illustrated in FIG. 22. The second series of rigid connectors have several modifications as follows: a first modified second series rigid connector 15''' is illustrated in FIGS. 28–30 (like parts are designated by the symbol ("'); a second modified second series rigid connector 15'''' is illustrated in FIGS. 25–27 (like parts are designated by the symbol ("")); a third modified second series rigid connector 15''''' is illustrated in FIGS. 32–34 (like parts are designated by the symbol ("'")); and a fourth modified second series rigid connector 15'''''' is illustrated in FIGS. 39–41 (like parts are designated by the symbol ("'")). The second series rigid connectors 15 are used in the greenhouse structure 69 illustrated in FIGS. 3–14, the bench structure 61 illustrated in FIG. 23, the log holder structure 54 illustrated in FIG. 24, and the bunk bed furniture structure 68 illustrated in FIGS. 36–38.

The rigid intersection connections 1, 1'', 1'''', 1''', 1''''', and 1'''''' illustrated in FIGS. 1, 2, 17, 25, 28 or 32 which includes third as well as second series rigid connectors include: a first elongated wood X structural member 2 having first, second, third, and fourth sides 3, 4, 5, and 6; a first: elongated wood Y structural member 7 intersecting the elongated wood X structural member 2 and having first, seat and second sides 8, 9, and 10; and a first elongated wood Z structural member 11 intersecting the elongated wood X and Y structural members 2 and 7 and having first, seat and second sides 12, 13, and 14.

First rigid connector $15^1$ is constructed from a single sheet of sheet metal 16 configured for holding the intersecting elongated wood X, Y, and Z structural members 2, 7, and 11 in a rigid embrace and includes: an XY support side member 17 dimensioned for registration with a portion of the first side 3 of the elongated wood X structural member 2; an XZ support side member 18 disposed at an angle 72 to the XY support side member 17 and integrally connected thereto along a substantial portion thereof and dimensioned for registration with the second side 4 of the elongated wood X structural member 2; a YX side member 19 integrally connected to the XY support side member 17 and dimensioned for registration with a portion of the first side 8 of the elongated wood Y structural member 7; the XY support side member 17 and the YX side member 19 forming a first angle 30; a ZX side member 20 integrally connected to the XZ support side member 18 and dimensioned for registration with a portion of the first side 12 of the elongated wood Z structural member 11; the XZ support side member 18 and the ZX side member 20 forming a second angle 31; a Y seat member 21 integrally connected to the YX side member 19 and dimensioned for registration with a portion of the seat side 9 of the elongated wood Y structural member 7; a Y side member 22 integrally connected to the Y seat member 21 and dimensioned for registration with a portion of the second side 10 of the elongated wood Y structural member 7; a Z seat member 23 integrally connected to the ZX side member 20 and dimensioned for registration with a portion of the seat side 13 of the elongated wood Z structural member 11; and a Z side member 24 integrally connected to the Z seat member 23 and dimensioned for registration with a portion of the second side 14 of the elongated wood Z structural member 11.

The first rigid connector $15^1$ is connected to the elongated wood structural members by first fastener means 25 attaching the XY support side member 17 to the first side 3 of the elongated wood X structural member 2; second fastener means 26 attaching the YX side member 19 to the first side 8 of the elongated wood Y structural member 7; third fastener means 27 attaching the Y side member 22 to the second side 10 of the elongated wood Y structural member 7; fourth fastener means 28 attaching the ZX side member 20 to the first side 12 of the elongated wood Z structural member 11; fifth fastener means 29 attaching the Z side member 24 to the second side 14 of the elongated wood Z structural member 11; and sixth fastener means 32 attaching the XZ support side member 18 to the second side 4 of the elongated wood X structural member 2.

The rigid intersection connections 1, 1'', and 1' illustrated in FIGS. 1. 2, 17, and 18 may be made even more rigid and hold greater loads by providing a Y side opening means 33 formed in the Y side member 22 permitting double shear fastening of the Y side member 22 to the elongated wood X structural member 2 and Z side opening means 34 formed in the Z side member 24 permitting double shear fastening of the Z side member to the elongated wood X structural member 2. Double shear attachment is by seventh fastener means 35 dimensioned for insertion through the Y side opening means 33, the elongated wood Y structural member 7 and into the elongated wood X structural member 2; and eighth fastener means 36 dimensioned for insertion through the Z side opening means 34, the elongated wood Z structural member 11 and into the elongated wood X structural member 2. Double shear fastening is fully explained in my U.S. Pat. No. 4,480,941 granted Nov. 6, 1984 entitled DOUBLE SHEAR ANGLED FASTENER CONNECTOR.

First Modified Second Series Rigid Connector

A first modified second series rigid connector 15''' is illustrated in FIGS. 28–30. This form of the invention has been found to be suitable for connecting smaller dimension lumber to larger dimension posts. The rigid intersection connection 1''' includes: a Y side extension 37 integrally connected to the Y side member 22''' at an angle 41 and disposed in registration with a portion of the elongated wood X structural member 2; and a Z side extension 38 integrally connected to the Z side member 24 at an angle 42 and disposed in registration with a portion of the elongated wood X structural member 2.

Connection is by ninth fastener means 39 piercing the Y side extension 37 and inserted into the elongated wood X structural member 2; and tenth fastener means 40 piercing the Z side extension 38 and inserted into the elongated wood X structural member 2.

Second Modified Second Series Rigid Connector

A second modified, second series rigid connector 15'''' is illustrated in FIGS. 25–27. This form of the invention is particularly suitable for lumber of the same thickness.

The rigid intersection connection 1'''' includes: a Y side extension interlock 43 integrally connected to the Y side member 22'''' at an angle 47 and disposed in registration with a portion of the Z side member 24''''; and a Z side extension interlock 44 integrally connected to the Z side member 24'''' at an angle 48 and disposed in registration with a portion of the Y side member 22''''. Connection is by eleventh fastener means 45 piercing the Y side extension interlock 43 and the Z side member 24'''' and inserted into the elongated wood Z structural member 11; and twelfth fastener means 46 piercing the Z side extension interlock 44 and the Y side member 22'''' and inserted into the elongated wood Y structural member 7.

Third Modified Second Series Rigid Connector

A third modified second series rigid connector 15''''' is illustrated in FIGS. 32–34. This form of the invention is particularly suitable for large dimension lumber.

The rigid intersection connection 1''''' includes: a Y side member extension X structural member interlock 49 integrally connected to the Y side member 22''''' at an angle 53 and disposed for registration with the Z side member 24'''''; a restricted opening 50 formed in the Y side member extension X structural member interlock 49; a restricted slot opening 51 formed in the Z side member 24''''' in registration with the restricted opening 50 formed in the Y side member extension X structural member interlock 49: and thirteenth fastener means 52 dimensioned for insertion through the restricted opening 50 formed in the Y side member extension X structural member interlock and the restricted slot opening 51 formed in the Z side member 24''''', and inserted into the elongated wood X structural member 2.

Tab 89 connected to Y seat member 21''''' and formed with a fastener opening for receipt of fastener 124 for insertion therethrough into elongated X structural member 2, and tab 90 connected to Z seat member 23''''' and formed with a fastener opening for receipt of fastener 124 for insertion therethrough into elongated X structural member 2 assist in increasing the rigidity of the rigid intersection connection 1'''''.

Fourth Modified Second Series Rigid Connector

A fourth modified second series rigid connector 15'''''' is illustrated in FIGS. 39–41. This form of the invention is particularly suitable for lumber of the same dimensional width and for structural rigidity.

The rigid intersection connection 1'''''' includes: a Y side extension overlap 57 integrally connected to the Y side member 22'''''' at an angle 59; a Z side extension overlap 58 integrally connected to the Z side member 24'''''' at an angle 60 and disposed in overlapping registration with the Y side extension overlap 57; and fifteenth fastener means 56 piercing the Y and Z side extension overlaps 57, and 58 and inserted into the first elongated wood X structural member 2.

Structure, (log holder)

Figure 24:
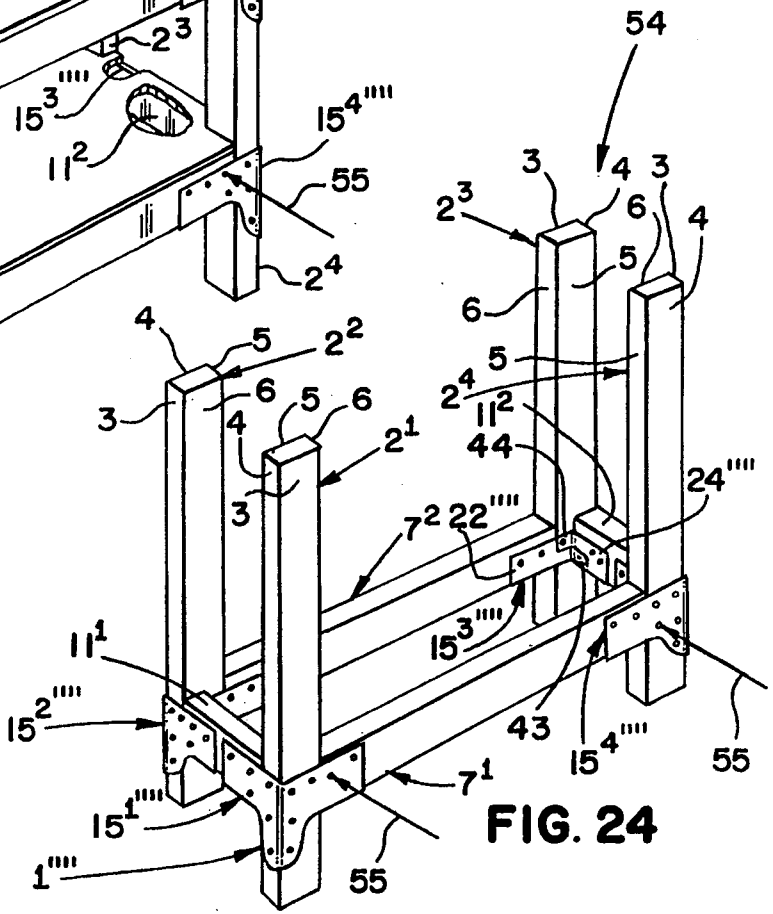
FIG. 24 is a perspective view of another furniture structure such as a log holder constructed from second modified, second series rigid connectors.

One of the simplest structures using a plurality of rigid intersection connections as described in the present invention is a log holder 54 which is illustrated in FIG. 24. This is only one example of a furniture structure, but it typifies one of the structures which takes advantage of the unique characteristics of the rigid connector of the present invention. Any one of the second series rigid connectors could be used, but as an example, the second modified second series rigid connector 15'''' as previously described in FIGS. 25—27 is illustrated.

The structure 54 as illustrated in FIG. 24 includes: a plurality of rigid intersection connections 1'''' including: a first elongated wood X structural member $2^1$ having first, second, third, and fourth sides 3, 4, 5, and 6; a second elongated wood X structural member $2^2$ having first, second, third and fourth sides 3, 4, 5, and 6 spaced from and disposed generally parallel To the first elongated wood X structural member $2^1$; a third elongated wood X structural member $2^3$ having first, second, third and fourth sides 3, 4, 5, and 6 spaced from and disposed generally parallel to the second elongated wood X structural member $2^2$; a fourth elongated wood X structural member $2^4$ having first, second, third and fourth sides 3, 4, 5, and 6 spaced from and disposed generally parallel to the first and third elongated wood X structural members $2^1$ and $2^3$; a second elongated wood Y structural member $7^2$ disposed parallel and spaced from the first elongated wood Y structural member $7^1$; a second elongated wood Z structural member $11^2$ disposed parallel and spaced from the first elongated wood Z structural member $11^1$; a first rigid connector $15^{1''''}$ connected to the first elongated wood X structural member $2^1$, a second rigid connector $15^{2''''}$ connected to the second elongated wood X structural member $2^2$, the first elongated wood Z structural member $11^1$ and the second elongated wood Y structural member $7^2$; a third rigid connector $15^{3''''}$ connected to the third elongated wood X structural member $2^3$, the second elongated wood Y structural member $7^2$ and the second elongated wood Z structural member $11^2$; a fourth rigid connector $15^{4''''}$ connected to the fourth elongated wood X structural member $2^4$, the second elongated wood Z structural member $11^2$ and the first elongated wood Y structural member $7^1$; and fastener means 55 attaching the first, second, third, and fourth rigid connectors $15^{2''''}$, $15^{3''''}$, $15^{4''''}$ to the elongated wood structural members $2^1$ $2^2$, $2^3$, $2^4$, $7^1$, $7^2$, $11^1$, and $11^2$.

The log holder 54 may be made of any dimension lumber, but a typical lumber size would be 2"×4" or nominal 2×4's.

Structure, (log holder), (second modified, second series rigid connector)

Referring again to the log holder structure illustrated in FIG. 24 and the second modified, second series rigid connector 15'''' illustrated in FIGS. 25–27 each of the first, second, third and fourth rigid connectors $15^{1''''}$, $15^{2''''}$ $15^{3''''}$, and $15^{4''''}$include: a Y side extension interlock 43 integrally connected to the Y side member 22'''' at an angle 47 and disposed in registration with a portion of the Z side member 24''''; a Z side extension interlock 44 integrally connected to the Z side member 24'''' at an angle 48 and disposed in registration with a portion of the Y side member 22''''; eleventh fastener means 45 piercing each of the Y side extension interlocks 43 and the Z side members 24'''' and inserted into the elongated wood Z structural members 11; and twelfth fastener means 46 piercing each of the Z side extension interlocks 44 and the Y side members 22'''' and inserted into the elongated wood Y structural members 7.

Furniture Structure, (four post work bench)

Another furniture structure which is uniquely adapted for construction with the rigid intersection connections of the present invention is a work bench. The work bench may have four or more legs such as the five leg work bench in FIG. 23. To minimize the number of drawings, a four leg work bench has not been specifically drawn; rather it may be readily envisioned that simply placing a table top means on the top of the log holder of FIG. 24 would readily result in the formation of a work bench or table.

Figure 23:
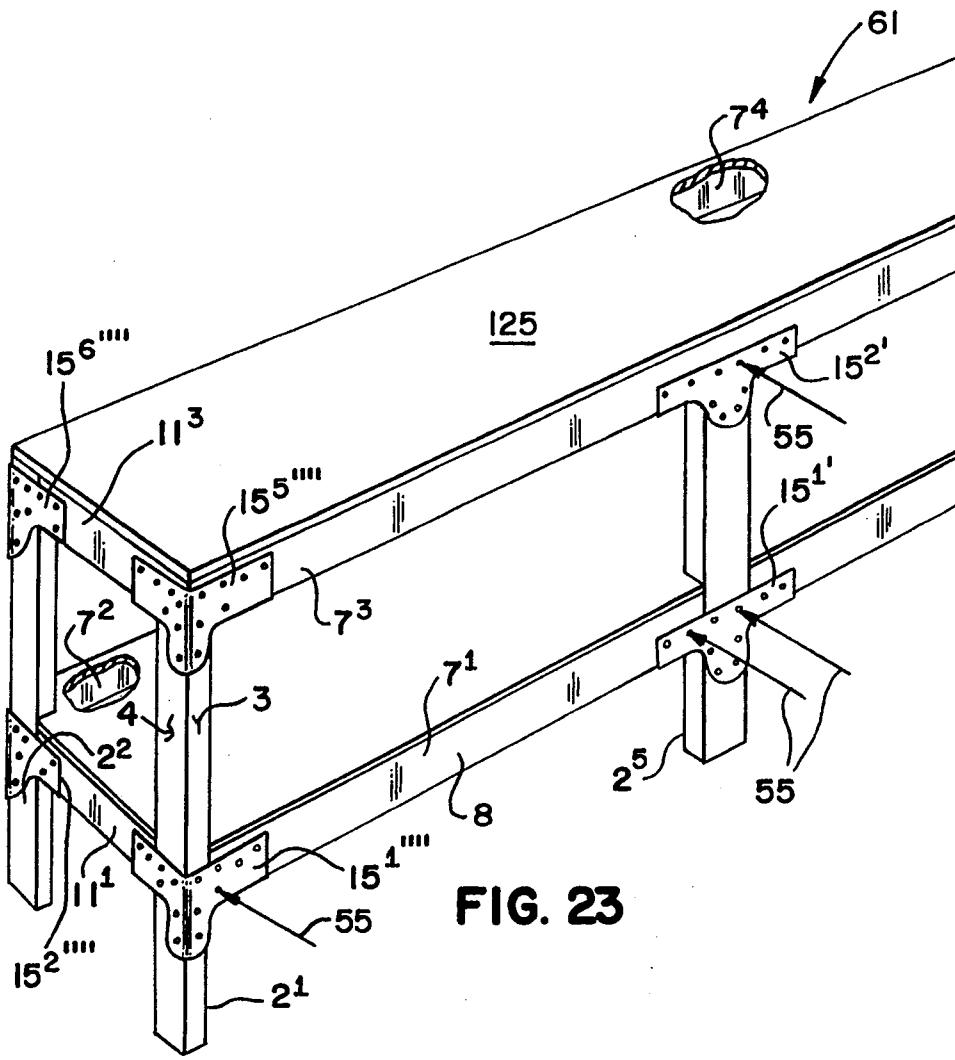
FIG. 23 is a perspective view of a furniture structure such as a work bench or table constructed from first series and second modified second series rigid connectors.

To construct an even sturdier work bench, horizontal wood structural members may be used as in the 5 post work bench of FIG. 23. The description which follows refers to a four leg work bench as illustrated in FIG. 24, but with the additional horizontal support members as illustrated in FIG. 23.

A furniture structure such as a work bench previously described may include: a third elongated wood Y structural member $7^3$ disposed from the first elongated wood Y structural member $7^1$ and in parallel relation thereto; a fourth elongated wood Y structural member $7^4$ disposed from the second elongated wood Y structural member $7^2$ and in parallel relation thereto; a third elongated wood Z structural member $11^3$ disposed from the first elongated wood Z structural member $11^1$ and in parallel relation thereto; a fourth elongated wood Z structural member $11^4$ disposed from the second elongated wood Z structural member $11^2$ and in parallel relation thereto; a fifth rigid connector $15^{5''''}$ disposed from the first rigid connector $15^{1''''}$ and connected to the first elongated wood X structural member $2^1$, the third elongated wood Y structural member $7^3$, and the third elongated wood Z structural member $11^3$; a sixth rigid connector $15^{6''''}$ connected to the second elongated wood X structural member $2^2$, the third elongated wood Z structural member $11^3$, and the fourth elongated wood Y structural member $7^4$; a seventh rigid connector $15^{7''''}$ disposed from the third rigid connector $15^{3''''}$ and connected to the third elongated wood X structural member $15^{3''''}$, the fourth elongated wood Z structural member $11^4$ and the fourth elongated wood Y structural member $7^4$; an eighth rigid connector $15^{8''''}$ disposed from the fourth rigid connector $15^{4''''}$ and connected to the fourth elongated wood X structural member $2^3$, the third elongated wood Y structural member $7^3$ and the fourth elongated wood Z structural member $11^4$; and the fastener means 55 also attach the fifth, sixth, seventh and eight rigid connectors $15^{5''''}$, $15^{6''''}$, $15^{7''''}$, and $15^{8''''}$ to the elongated wood structural member $7^3$, $11^3$, $7^4$, $11^4$, $2^1$, $2^2$, $2^3$, and $2^4$.

Furniture Structure (five post work bench)

FIG. 23 is an illustration of a 5 post work bench. The description which follows includes the description of the four post work bench set forth above. While the work bench may be constructed from any of the rigid connectors previously described, the description which follows is based on the second series rigid connectors illustrated in FIGS. 1 and 2 and the first series rigid connector illustrated in FIG. 18.

The furniture structure 61 illustrated in FIG. 23 includes: a fifth elongated wood X structural member $2^5$ disposed between the first and fourth elongated wood X structural members $2^1$ and $2^4$; a first, first series rigid connector $15^2$, which includes: an XY support side member 17' dimensioned for registration with a portion of the fifth elongated wood X structural member $2^5$; an XZ support side member 18' integrally connected to the XY support side member 17' along a substantial portion thereof and dimensioned for registration with a portion of the fifth elongated wood X structural member $2^5$; a YX side member 19' integrally connected to the XY support side member 17' and dimensioned for registration with a portion of the first side 8 of the first elongated wood Y structural member $7^1$; a ZX side member 20' integrally connected to the XZ support side member 18' and dimensioned for registration with a portion of the first side 8 of the first elongated wood Y structural member $7^1$; a Y seat member 21' integrally connected to the YX side member 19' and dimensioned for registration with a portion of the seat side 9 of the first elongated wood Y structural member $7^1$; a Y side member 22' integrally connected to the Y seat member 21' and dimensioned for registration with a portion of the second side 10 of the first elongated wood Y structural member $7^1$; a Z seat member 23' integrally connected to the ZX side member 20' and dimensioned for registration with a portion of the seat side 9 of the first elongated wood Y structural member $7^1$; a Z side member 24' integrally connected to the Z seat member 23' and dimensioned for registration with a portion of the second side 14 of the first elongated wood Y structural member $7^1$; and the XY and XZ support side members 17' and 18' are in substantially the same plane; a second, first series rigid connector $15^2$, spaced from the first, first series rigid connector $15^{1'}$ including: an XY support side member 17' dimensioned for registration with a portion of the fifth elongated wood X structural member $2^5$, an XZ support side member 19' integrally connected to the XY support side member 17'along a substantial portion thereof and dimensioned for registration with a portion of the fifth elongated wood X structural member $2^5$; a YX side member 19' integrally connected to the XY support side member 17' and dimensioned for registration with a portion of the first side 8 of the third elongated wood Y structural member $7^3$; a ZX side member 20' integrally connected to the XZ support side member 18' and dimensioned for registration with a portion of the first side 8 of the third elongated wood Y structural member $7^3$; a Y seat member 21' integrally connected to the YX side member 19 and dimensioned for registration with a portion of the seat side 9 of the third elongated wood Y structural member $7^3$; a Y side member 22' integrally connected to the Y seat member 21' and dimensioned for registration with a portion of the second side 10 of the third elongated wood Y structural member $7^3$; a Z seat member 23' integrally connected to the ZX side member 20' and dimensioned for registration with a portion of the seat side 9 of the third elongated wood Y structural member $7^1$; a Z side member 24' integrally connected to the Z seat member 23' and dimensioned for registration with a portion of the second side 14 of the third elongated wood Y structural member $7^3$; and the XY and XZ support side members 17' and 18' are in substantially the same planes; and the fastener means 55 also attach the first and second first series rigid connectors $15^1$, and $15^{2'}$ to the elongated wood structural members $2^5$, $7^1$, and $7^3$.

Table surface 125 may be attached to third and fourth elongated wood Y structural members $7^3$ and $7^4$ and third and fourth elongated wood Z structural members $11^3$ and $11^4$.

Figure 36:
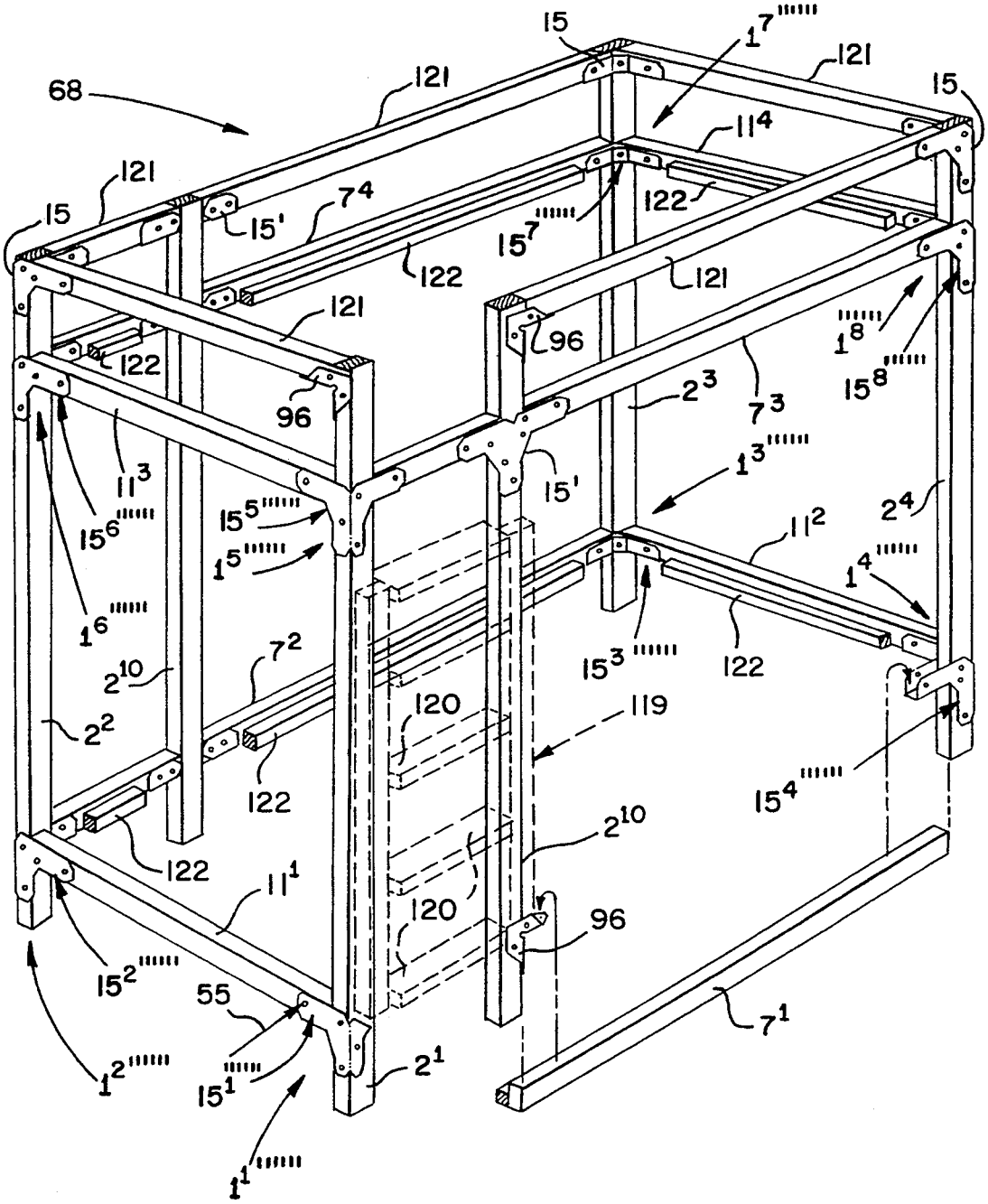
FIG. 36 is a perspective view of a furniture structure such as a bunk bed constructed from the rigid intersection connections of the present invention.
Figures 37, 38:
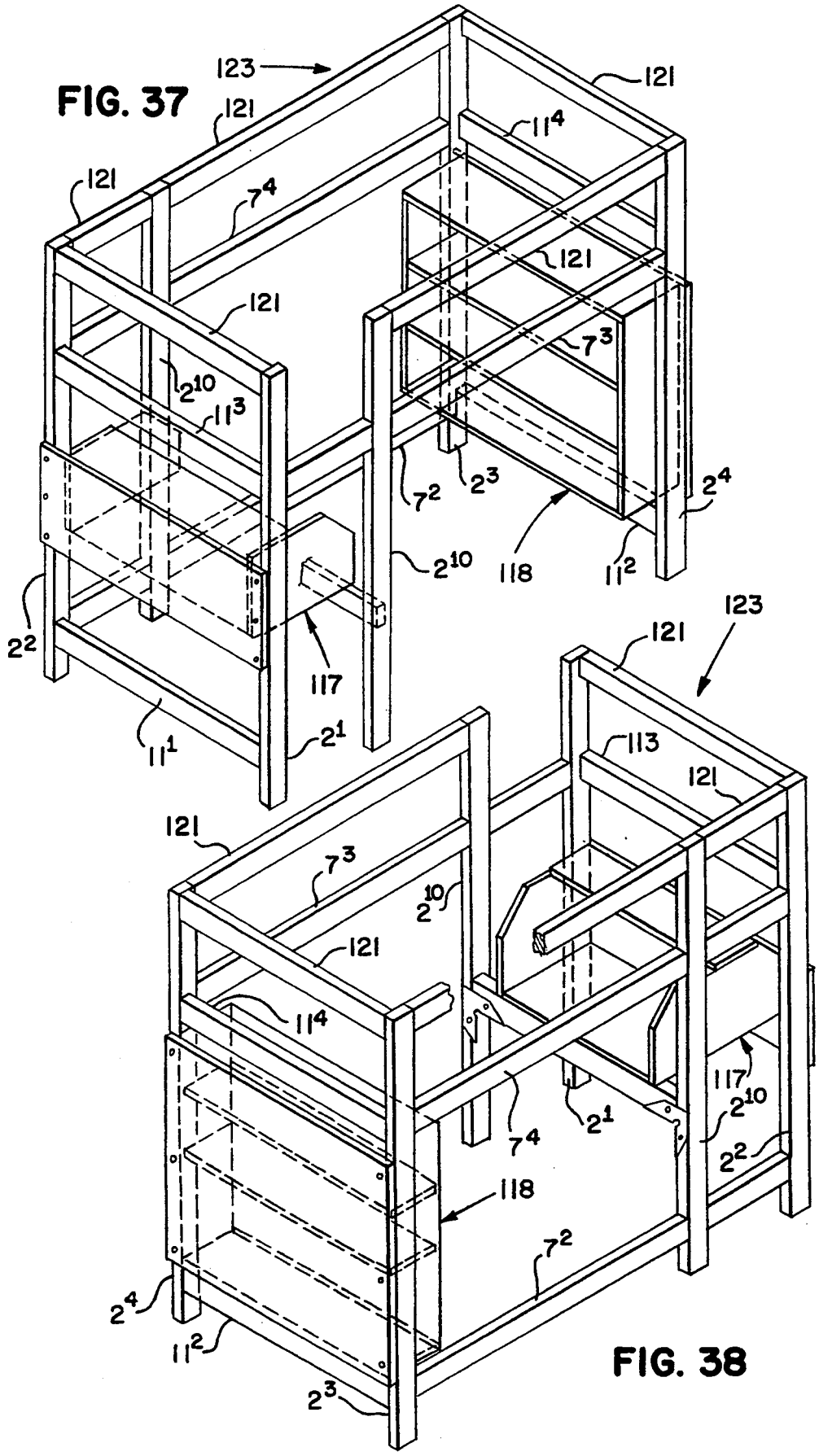
FIG. 37 is a perspective view of the front side of a combination study unit and bunk bed using the rigid intersection connections of the present invention.
FIG. 38 is a perspective view of the rear side of the combination study unit and bunk bed illustrated in FIG. 37.
Figure 42:
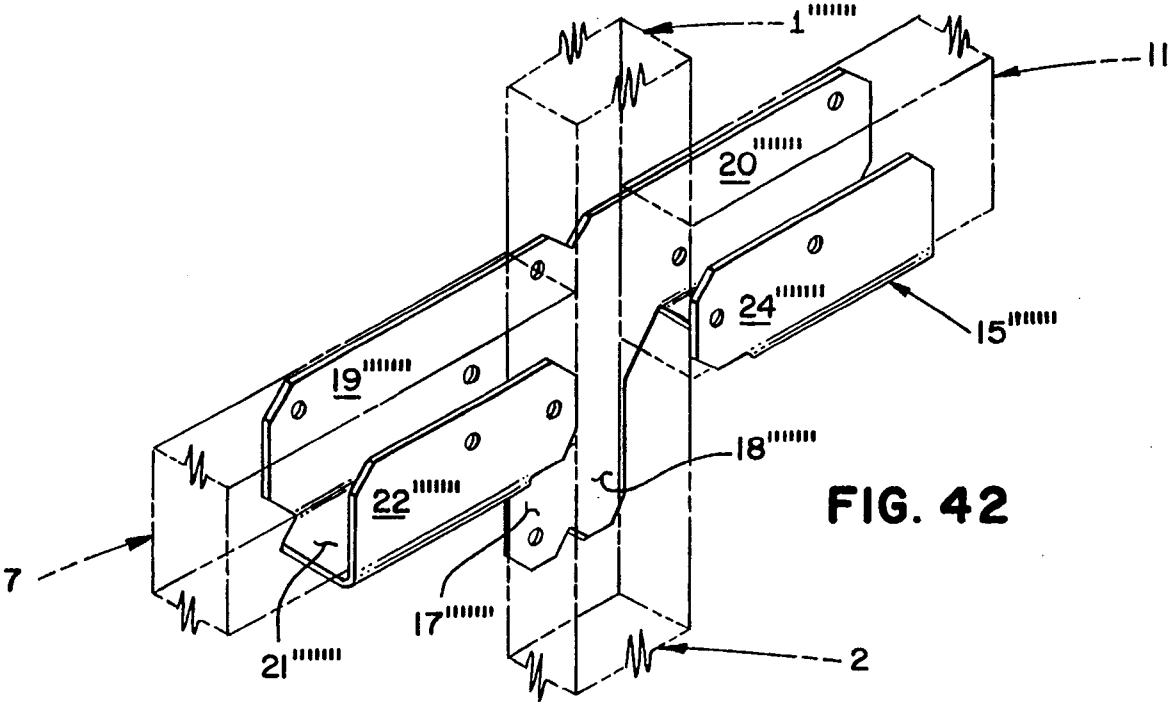
FIG. 42 is a perspective view of the rigid intersection connection constructed with another form of a first series rigid connector.
Figure 43:
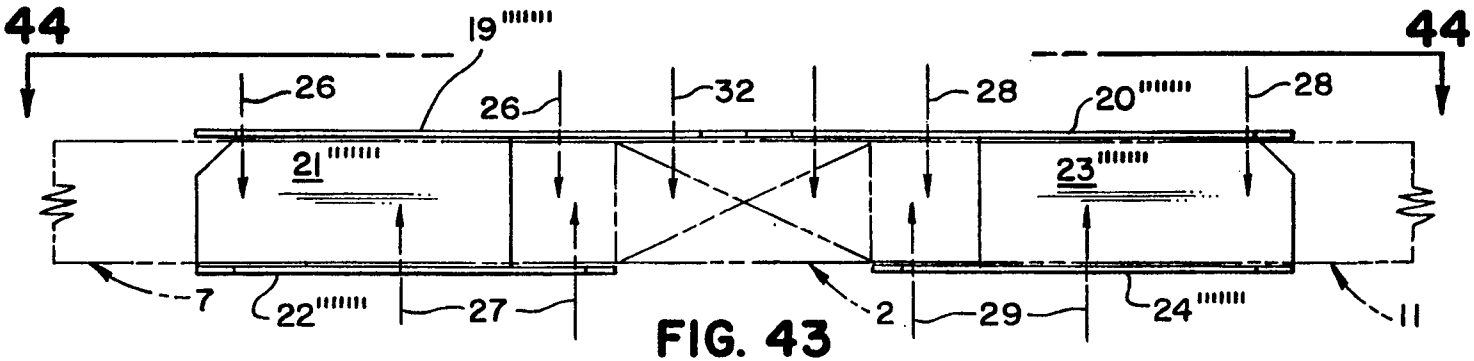
FIG. 43 is a top plan view of the rigid intersection connection illustrated in FIG. 42.
Figure 45:
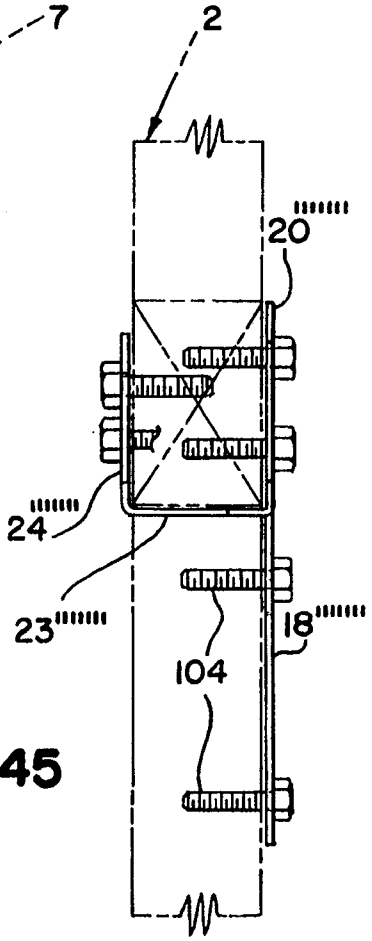
FIG. 45 is an end elevation view of the rigid intersection connection illustrated in FIG. 44 taken generally along line 45—45.
Figure 44:
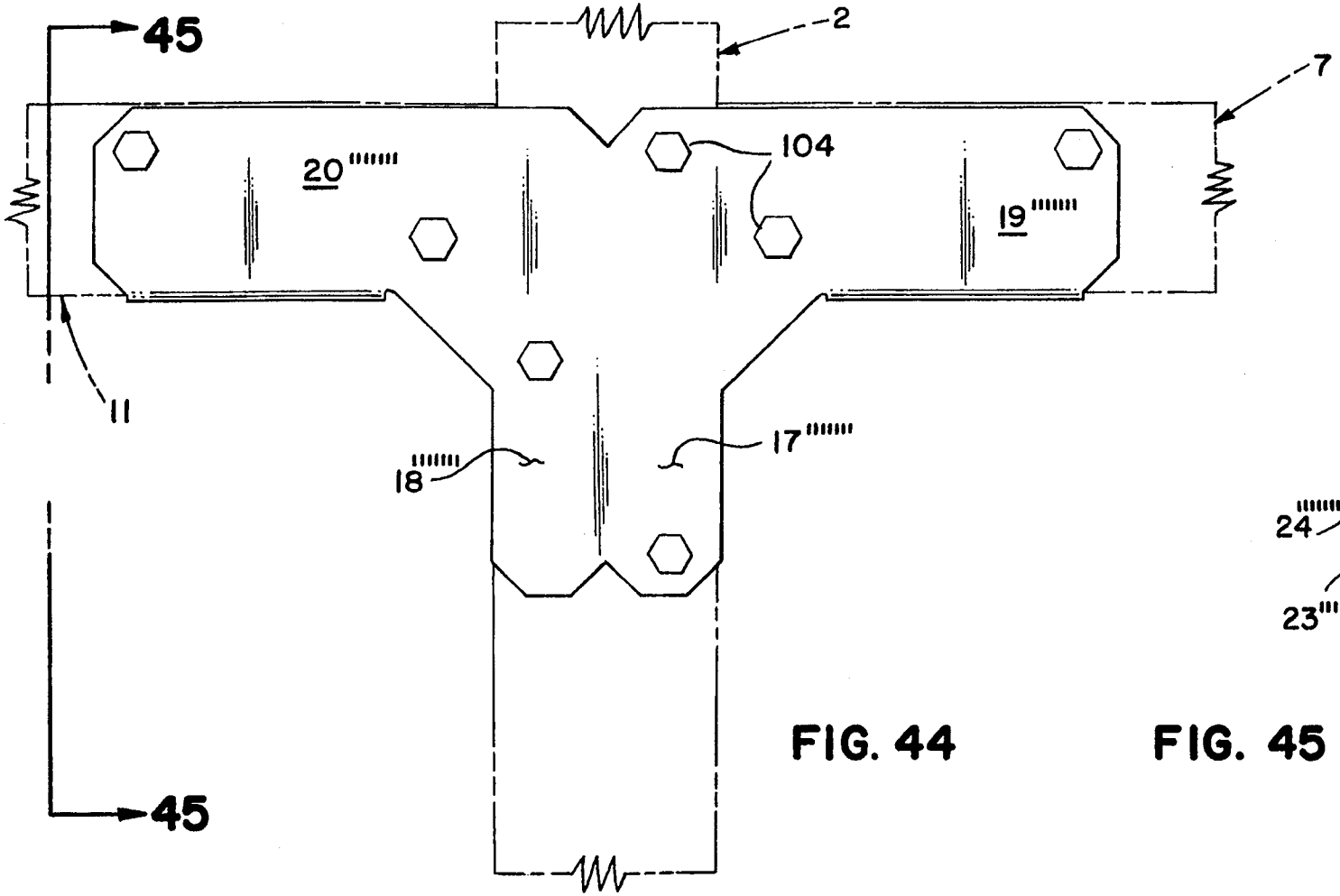
FIG. 44 is a side elevation view of the rigid intersection connection illustrated in FIG. 43 taken generally along line 44—44.

Use of eight rigid connectors in any furniture structure such as the table structure illustrated in FIG. 23 or the bunk bed illustrated in FIGS. 36–38 which follow eliminates the need for any diagonal bracing.

Furniture Structure, (bunk bed)

The use of a plurality of rigid intersection connections of the present invention forming structures based on rectangles instead of triangles, makes it possible to form many useful structures with very little change in the basic structure. For example, the construction of a 4 post table using the basic structure of the log holder 54 in FIG. 24 also may result in the formation of a basic 4 poster bunk bed (not shown but similar to the structure of FIG. 36).

Figure 2:
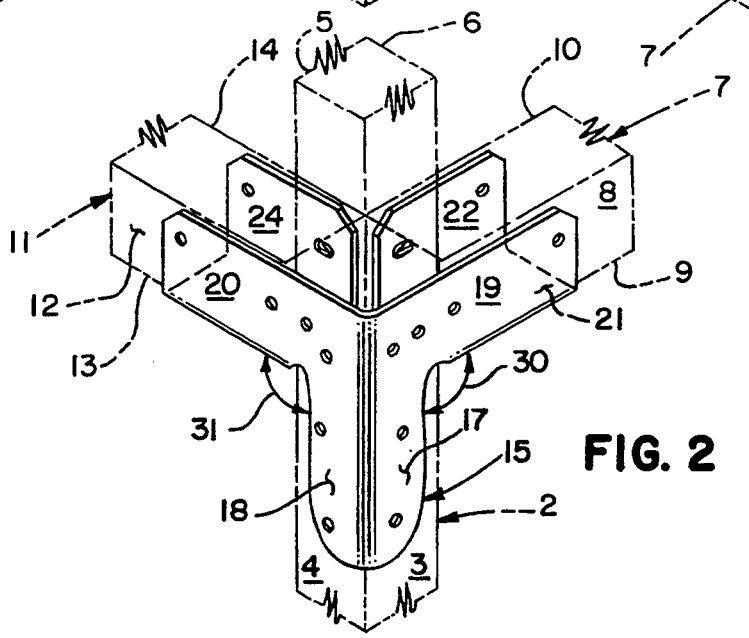
FIG. 2 is a perspective view of the rigid intersection connection illustrated in FIG. 1 taken from a different vantage point so as to show the front and back of the second series rigid connector.

The description that follows is therefore a continuation of the description of the four post bench but instead of using the second series rigid connectors previously described and illustrated in FIGS. 1 and 2, the fourth modified, second series rigid connectors illustrated in FIGS. 39 and 41 is used.

The furniture structure such as a four post bunk bed may include the structure previously described for a four post table and also include: the first through eighth rigid connectors $15^{1''''''}$ through $15^{8''''''}$ each of which include: a Y side extension overlap 57 integrally connected to the Y side member $2^{2''''''}$ at an angle 59; a Z side extension overlap 58 integrally connected to the Z side member $2^{4''''''}$ at an angle 60; fifteenth fastener means 56 piercing each of the Y and Z side extension overlaps 57 and 58 and inserted into each of the first, second, third, and fourth elongated wood X structural members $2^1$, $2^2$, $2^3$, and $2^4$.

Building Structure, (greenhouse, flat roof)

Amazingly, the rigid intersection connection of the present invention is capable of constructing a log holder, a work bench and a bunk bed, but it is uniquely capable of constructing an entire building based on one rigid connector. The structure illustrated in FIGS. 2–14 may be a storage shed, tool house or greenhouse or other garden utilitarian structure. Note that the structure is based on a series of rectangles rather than a series of triangles as in all other building structures. The use of rectangles rather than triangles permits windows, doors, vents or other openings to be placed anywhere in the structure; even at corners because there is no interfering diagonal members.

Use of the intersecting connections of the present invention eliminates the need for plywood or other sheathing to create shear walls in building structures. Thus glass or plastic panels may be fitted in each of the rectangles in the greenhouse illustrated in FIGS. 2–14.

The greenhouse described in this application may have a flat roof, a shed roof or a peaked roof. The description which follows relates to a flat roofed greenhouse which is not shown in order to reduce the number of drawings in this application. The rigid connectors used in the construction of the greenhouse structure may be any of those described. A full description of each rigid connector is not repeated as the description has been set forth above for each of the different series connectors. In determining the particular rigid connector, one may refer to the previous description, the claims and the drawings.

Figure 3:
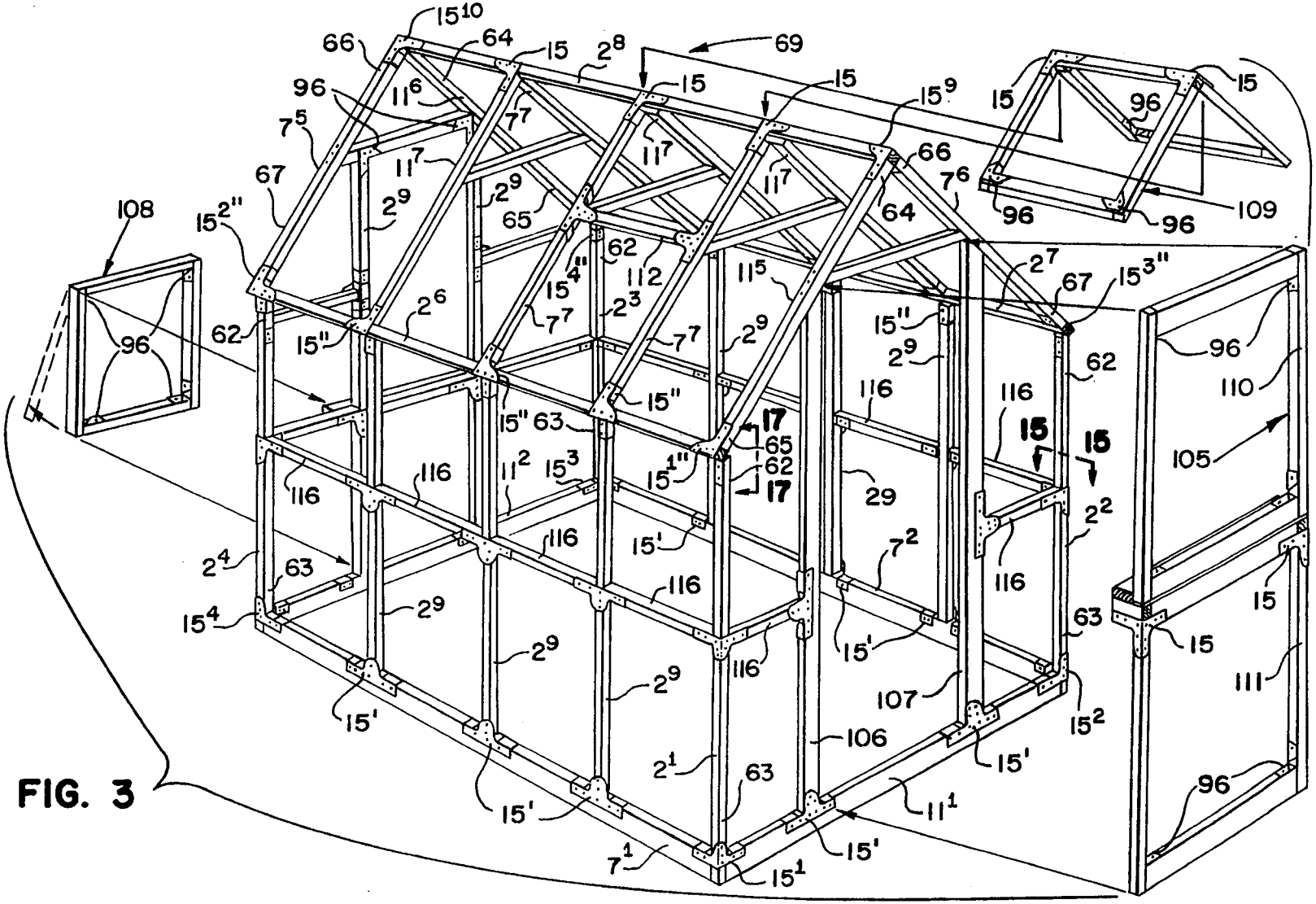
FIG. 3 is a perspective view of a building structure such as a greenhouse or shed of the present invention utilizing a plurality of first, second and third series rigid connectors with portions of the structure removed to one side for purposes of clarification.
Figure 4:
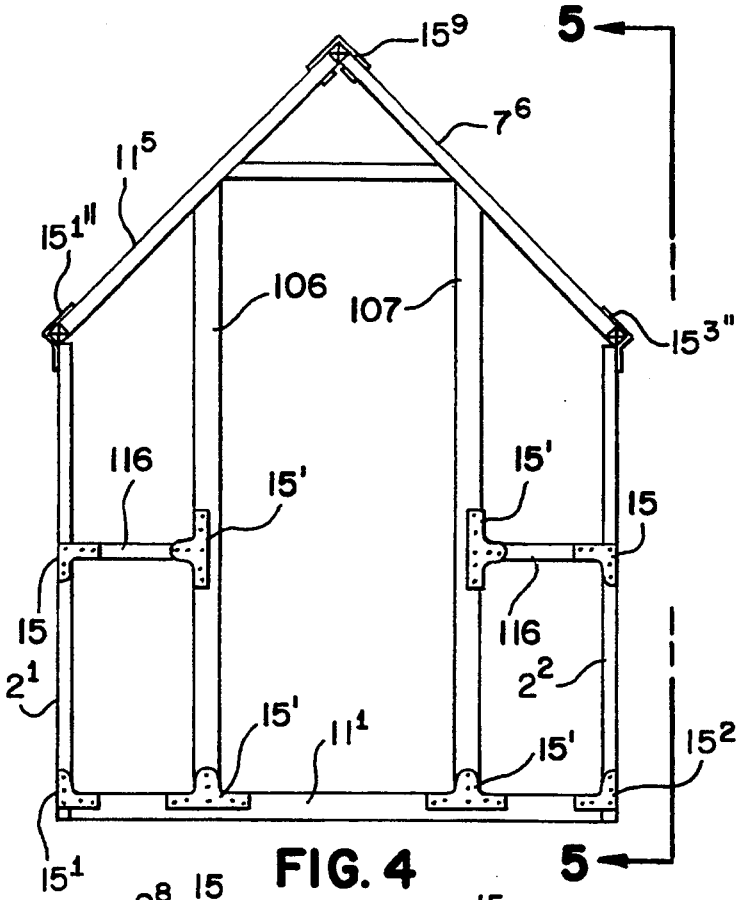
FIG. 4 is a front elevation view of the building structure illustrated in FIG. 3 and a shorter version of such a building structure.
Figure 6:
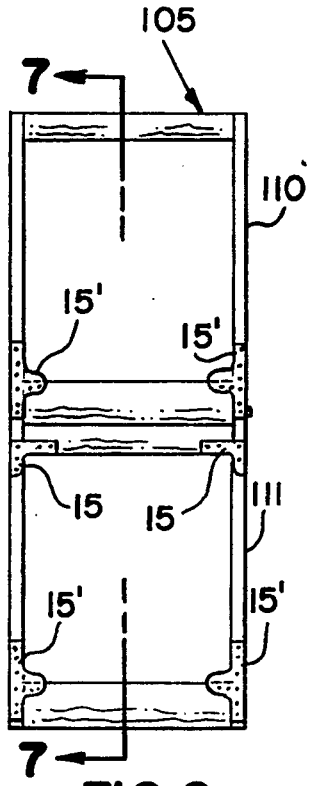
FIG. 6 is a front view of a door constructed to fit in the opening in FIG. 4.
Figure 5:
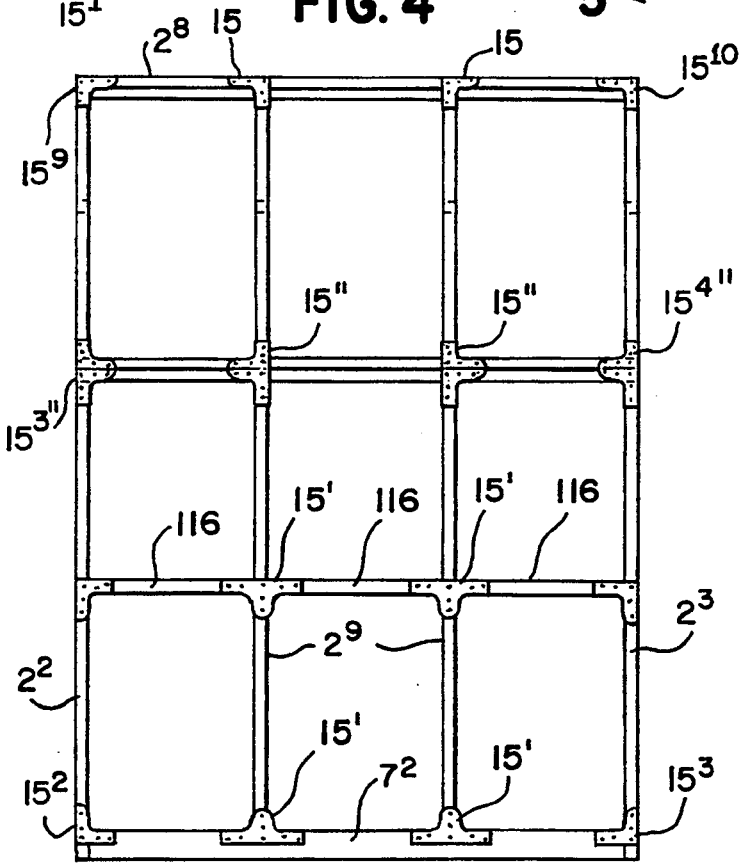
FIG. 5 is a side elevation view of the shorter version building structure illustrated in FIG. 3 taken along line 5—5 in FIG. 4.
Figure 7:
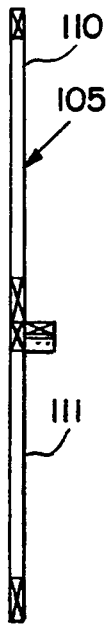
FIG. 7 is a cross sectional view of the door illustrated in FIG. 6 taken along line 7—7.
Figure 8:
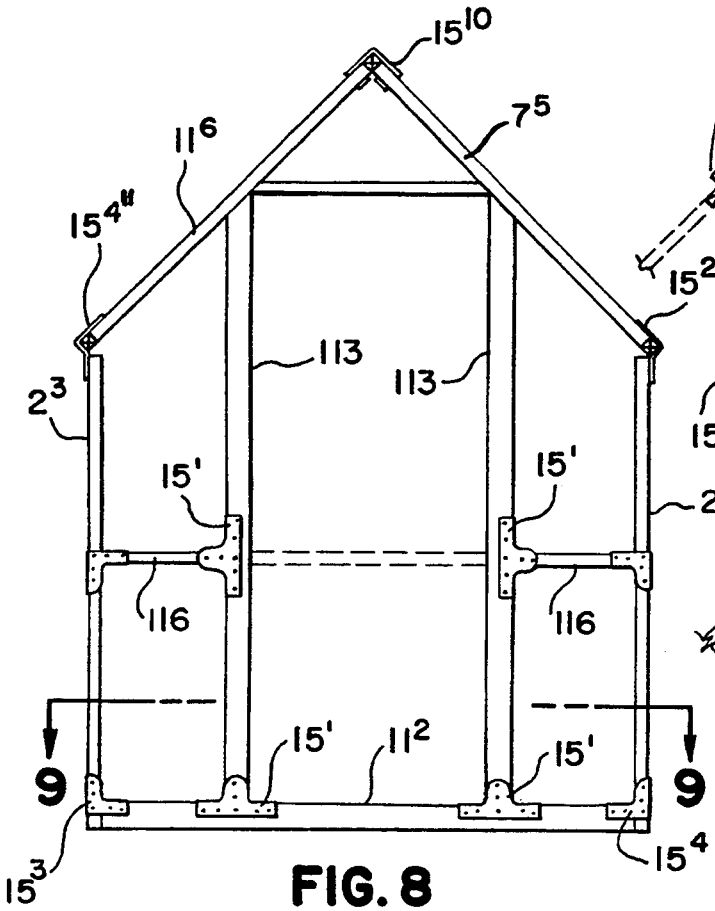
FIG. 8 is a rear elevation view of the building structure illustrated in FIG. 3 or a shorter version of such a building structure.
Figure 10:
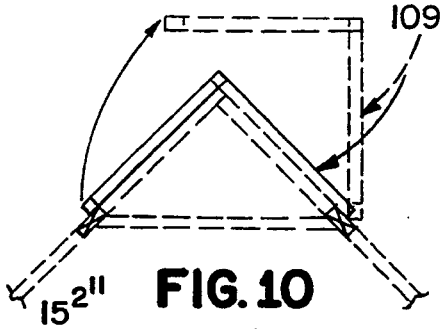
FIG. 10 is a cross sectional detail view of the roof vent of the building structure illustrated in FIG. 3 with dashed lines showing the vent in the open position.
Figure 11:
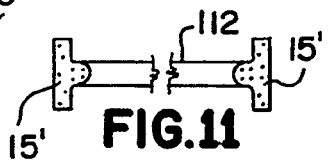
FIG. 11 is a plan view of a portion of the framing for the roof vent shown in FIG. 3.
Figure 12:
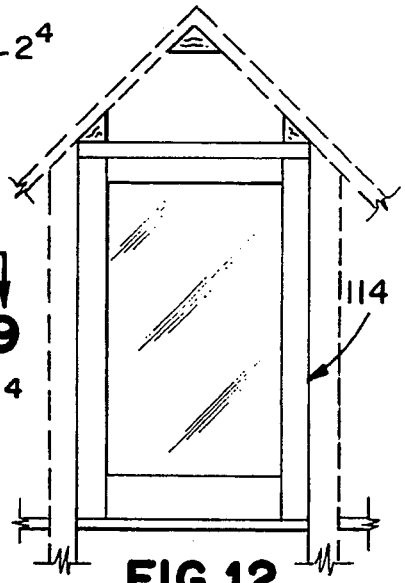
FIG. 12 is an alternate window construction for the structure illustrated in FIG. 8.
Figure 9:
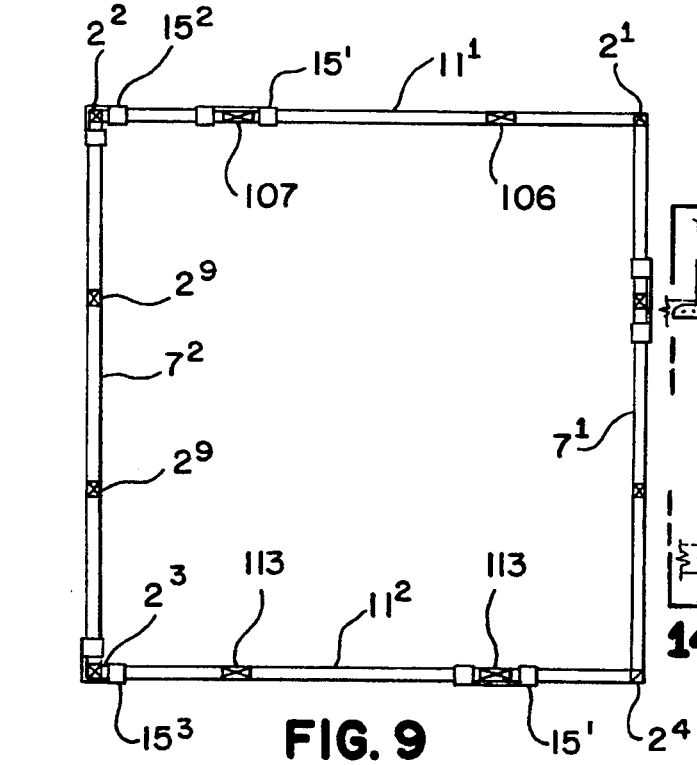
FIG. 9 is a cross sectional view of the shorter version of the building structure of FIG. 8 taken along line 9—9.
Figures 13, 14:
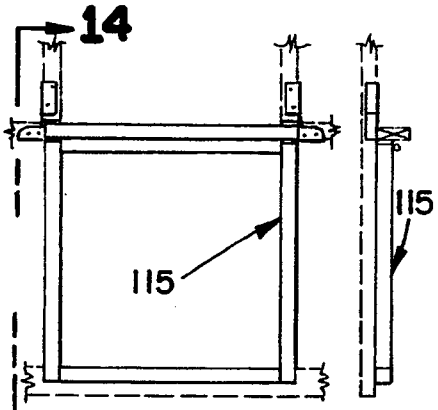
FIG. 13 is an alternate vent structure for the structure illustrated in FIG. 8
FIG. 14 is a side view partially in cross section taken along line 14—14 of FIG. 13.

Referring specifically to FIG. 3, the building structure includes: a first elongated wood X structural member $2^1$ having first, second, third, and fourth sides 3, 4, 5, and 6 and upper and lower ends 62 and 63, a second elongated wood X structural member $2^2$ disposed generally parallel to and spaced from the first elongated wood X structural member $2^1$ and having first, second, third and fourth sides 3, 4, 5, and 6 and upper and lower ends 62 and 63; a third elongated wood X structural member $2^3$ spaced from and disposed generally parallel to the second elongated wood X structural member $2^2$ and having first, second, third and fourth sides 3, 4, 5, and 6 and upper and lower ends 62 and 63; a fourth elongated wood X structural member $2^4$ spaced from and disposed generally parallel to the first and third elongated wood X structural members $2^1$ and $2^3$ and having first, second, third and fourth sides 3, 4, 5, and 6 and upper and lower ends 62 and 63; the first, second, third, and fourth elongated wood X structural members $2^1$, $2^2$, $2^3$, $2^4$ provide corner studs in the building structure; a first elongated wood Y structural member $7^1$ disposed between and intersecting the first and fourth elongated wood X structural members $2^1$ and $2^4$ and having first, second, third, and fourth sides 3, 4, 5, and 6; a first elongated Z structural member $11^1$ disposed between and intersecting the first and second elongated wood X structural members $2^1$ and $2^2$ and having first, second, third, and fourth sides 3, 4, 5, and 6; a second elongated wood Y structural member $7^2$ disposed parallel and spaced from the first elongated wood Y structural member $7^1$ and intersecting the second and third elongated X structural members $2^2$ and $2^3$ and having first, second, third, and fourth sides 3, 4, 5, and 6; a second elongated wood Z structural member $11^2$ disposed parallel and spaced from the first elongated wood Z structural member $11^2$, and intersecting the second and third elongated wood X structural members $2^2$ and $2^3$ and having first, second, third and fourth sides 3, 4, 5, and 6; the first and second elongated wood Y structural members $7^1$ and $7^2$ and the first and second elongated wood Z structural members $11^1$ and $11^2$ form a perimeter sill in the building; a first, second series rigid connector $15^1$ connected to and forming a rigid interconnection with the first elongated wood X structural member $2^1$, the first elongated wood Y structural member $7^1$ and the first elongated wood Z structural member $11^1$; a second, second series rigid connector means $15^2$ connected to and forming a rigid interconnection with the second elongated wood X structural member $2^2$, the first elongated wood Z structural member $11^1$ and the second elongated wood Y structural member $7^2$; a third, second series rigid connector means $15^3$ connected to and forming a rigid interconnection with the third elongated wood X structural member $2^3$, the second elongated wood Y structural member $7^2$ and the second elongated wood Z structural member $11^2$; a fourth, second series rigid connector means $15^4$ connected to and forming a rigid interconnection with the fourth elongated wood X structural member $2^4$, the second elongated wood Z structural member $11^2$ and the first elongated wood Y structural member $7^1$; roof means such as a flat structure connected to the upper portions 62 of the elongated wood X structural members $2^1$, $2^2$, $2^3$, and $2^4$; fastener means 25–29, 32, and 56 attaching the first, second, third, and fourth, second series rigid connectors $15^1$, $15^2$, $15^3$, and $15^4$, to the elongated wood structural members $2^1$, $2^2$, $2^3$, $2^4$, $11^1$, $7^2$, $11^2$ and $7^1$; and the first elongated wood X structural member $2^1$, the first elongated wood Y structural member $7^1$, the fourth elongated wood X structural member $2^4$ and the roof means form a rectangular opening.

Building structure, (shed roof)

The previously described building structure with a flat roof may also be formed with a shed or slanting roof by simply adding third series rigid connectors illustrated in FIG. 17 and previously described. The additional structure for a shed roof building structures includes: the first, second, third, and fourth elongated wood X structural members have upper ends 62; a sixth elongated wood X structural member $2^6$ disposed adjacent the upper ends 62 of the first and fourth elongated wood X structural members $2^1$ and $2^4$; a fifth elongated wood Z structural member $11^5$ having an upper end 64 and a lower end 65 intersecting the sixth elongated wood X structural member $2^6$ and disposed in close association with the upper end 62 of the first elongated wood X structural member $2^2$; a fifth elongated wood Y structural member $7^5$ having an upper end 66 and having a lower end 67 intersecting the sixth elongated wood X structural member $2^6$ and disposed in close association with the upper end 62 of the fourth elongated wood X structural member $2^4$; a first, third series rigid connector means $15^{1''}$ connected to and forming a rigid interconnection with the sixth elongated wood X structural member $2^6$, the first elongated wood X structural member $2^1$ and the fifth elongated wood Z structural member $11^5$; a second, third series rigid connector means $15^{2''}$ connected to and forming a rigid interconnection with the sixth elongated wood X structural member $2^6$, the fourth elongated wood X structural member $2^4$, and the fifth elongated wood Y structural member $7^5$; and panel means connecting the upper ends 64 and 66 of the fifth elongated wood Z structural member $11^5$ and the fifth elongated wood Y structural member $7^5$ and the upper ends 62 of the second and third elongated wood X structural members $2^2$ and $2^3$.

Building structure (peaked roof)

The building structure with a peaked roof is illustrated in FIGS. 3–14. This structure differs only with the previously shed roofed structure in that two additional third series rigid connectors illustrated in FIG. 17 are required and two additional second series rigid connectors are added. Any of the second series rigid connectors previously described may be used.

The peaked roof building structure 69 illustrated in FIG. 3 in addition to the description for the shed roof structure includes: a seventh elongated wood X structural member $2^7$ disposed adjacent the upper ends 62 of the second and third elongated wood X structural members $2^2$ and $2^3$; an eighth elongated wood X structural member $2^8$ disposed from and parallel to the sixth and seventh elongated wood structural X members $2^6$ and $2^7$; a sixth elongated wood Y structural member $7^6$ having upper and lower ends 66 and 67 and intersecting the seventh and eighth elongated wood X structural members $2^7$ and $2^8$ and the fifth elongated wood Z structural member $11^5$, and the lower end 67 being disposed in close association with the upper enlongated 62 of the second elongated wood X structural member $2^2$; a sixth elongated wood Z structural member $11^6$ having upper and lower ends 64 and 65 and intersecting the seventh elongated wood X structural member $2^7$ and the fifth elongated wood Y structural member $7^5$, and disposed in close association with the upper end 62 of the third elongated wood X structural member $2^3$; a third, third series rigid connector means $15^{3''}$ connected to and forming a rigid interconnection with the seventh elongated wood X structural member $2^7$, the second elongated wood X structural member $2^2$ and the sixth elongated wood Y structural member $7^6$; a fourth, third series rigid connector means $15^{4''}$ connected to and forming a rigid interconnection with the seventh elongated wood X structural member $2^7$, the third elongated wood X structural member $2^3$, and the sixth elongated wood Z structural member $11^6$; a ninth, second series rigid connector means $15^9$ connected to and forming a rigid interconnection with the eighth elongated wood X structural member $2^8$, the sixth elongated wood Y structural member $7^6$ and the fifth elongated wood Z structural member $11^5$; a tenth, second series rigid connector means $15^{10}$ connected to and forming a rigid interconnection with the eighth elongated wood X structural member $2^8$, the fifth elongated wood Y structural member $7^5$ and the sixth elongated wood Z structural member $11^6$; and fastener means 55 attaching the third and fourth, third series rigid connectors $15^{3''}$ and $15^{4''}$ and the ninth and tenth second series rigid connectors $15^9$ and $15^{10}$ to the elongated wood structural members $2^7$, $2^8$, $7^6$, $11^6$, $11^5$, and $7^5$.

Construction of rigid connectors

Surprisingly, the first, second, and third series connectors 15', 15, and 15'' are all constructed from the same sheet metal blank 16 illustrated in FIG. 22.

Second Series Rigid Connector

The second series rigid connector 15 illustrated in FIGS. 1,2, 15 and 16 is constructed from sheet metal blank 16 illustrated in FIG. 22 as follows: XY support side member 17 is bent up 90° along bend line 73, Y seat member 21 is bent up 90° along bend line 74, Y side member 22 is bent up 90° along bend line 75, Z seat member 23 is bent up 90° along bend line 76 and Z side member 24 is bent up 90° along bend line 77.

First Series Rigid Connector

First series rigid connector 15' illustrated in FIGS. 18–21 is constructed from sheet metal blank 16 illustrated in FIG. 22 in the exact same manner as second series rigid connector 15 explained above except that no bend is made along bend line 73.

Third Series Rigid Connector

Third series rigid connector 15'' illustrated in FIG. 17 is constructed from sheet metal blank 16 illustrated in FIG. 22 in the exact same manner as second series rigid connector 15 except that variable bends may be made in either bend line 78 or 79 depending on the slope required as in the sloping roof for the greenhouse 69 illustrated in FIG. 3.

First Modified, Second Series Rigid Connector

First modified, second series rigid connector 15''' illustrated in FIGS. 8–30 is constructed from sheet metal blank 80 illustrated in FIG. 31 as follows: XY support side member 17''' is bent up 90° along bend line 73''', Y seat member 21''' is bent up 90° along bend line 74''', Y side member 22''' is bent up 90° along bend line 75''', Z seat member 23''' is bent up 90° along bend line 76''' and Z side member 24''' is bent up 90° along bend line 77'''. Y side extension 37 is then bent down 90° along bend line 81, Z side extension 38 is then bent down 90° along bend line 82, and blank 80 is cut along cut line 83 and cut line 84.

Second Modified, Second Series Rigid Connector

Figure 31:
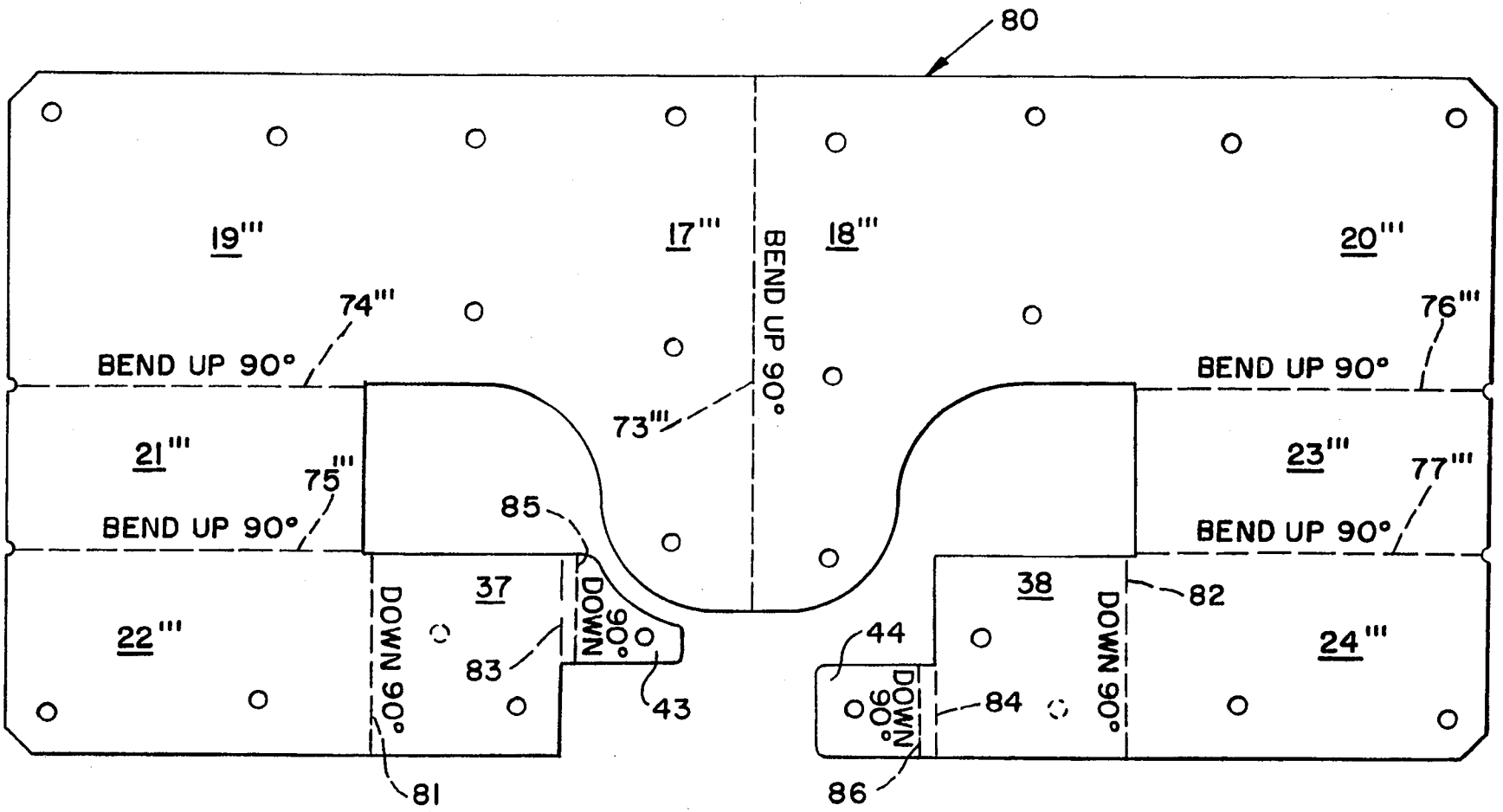
FIG. 31 is a top plan view of a sheet metal blank used in constructing either the first modified, second series rigid connector illustrated in FIG. 28 or the second modified, second series rigid connector illustrated in FIG. 25.

Second modified, second series rigid connector 15'''' illustrated in FIGS. 25–27 is constructed from the same sheet metal blank 80 illustrated in FIG. 31 as first modified, second series rigid connector 15''', except that no cuts are made along line cut lines 83 and 84, nor is any bend made along bend lines 81 and 82. Instead, Y side extension interlock 43 is bent down 90° along bend line 85 and Z side extension interlock 44 is bent down 90° along bend line 86.

Third Modified, Second Series Rigid Connector

Figure 35:
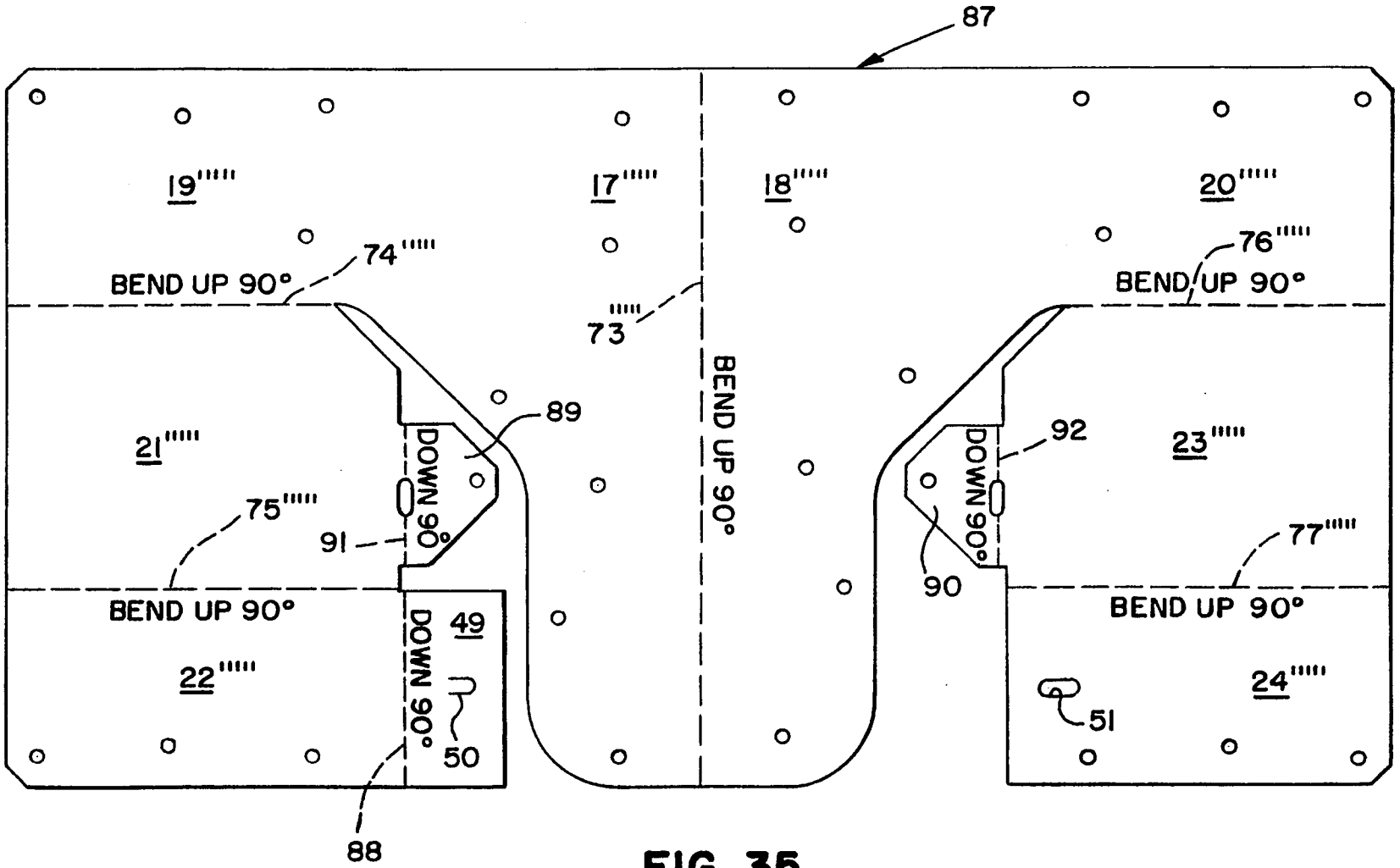
FIG. 35 is a top plan view of a sheet metal blank from which the third modified, second series rigid connector of FIG. 32 is constructed.

Third modified, second series rigid connector 15''''' illustrated in FIGS. 32–34 is constructed from sheet metal blank 87 illustrated in FIG. 35 as follows: XY support side member 17''''' is bent up 90° along bend line 73''''', Y seat member 21'''''is bent up 90° along bend line 74''''', Y side member 22''''' is bent up 90° along bend line 75''''', Z seat member 23''''' is bent up 90° along bend line 76''''' and Z side member 24''''' is bent up 90° along bend line 77'''''. In addition, Y side member extension X structural member interlock 49 is bent down 90° along bend line 88, and tabs 89 and 90 are bent down 90° along bend lines 91 and 92.

Fasteners 124 attach tabs 89 and 90 to elongated wood structural member 2.

Fourth Modified, Second Series Rigid Connector

Fourth modified, second series rigid connector 15'''''' illustrated in FIGS. 39–41 is constructed from sheet metal blank 93 illustrated in FIG. 46 as follows: XY support side member 17'''''' is bent down 90° along bend line 73'''''', Y seat member 21 is bent down 90° along bend line 74'''''', Y side member 22'''''' is bent down 90° along bend line 75'''''', Z seat member 23'''''' is bent down 90° along bend line 76'''''' and Z side member 24'''''' is bent down 90° along bend line 77'''''' In addition, Y side extension overlap 57 is bend up 45° along bend line 94 and Z side extension overlap 58 is bent up 45° along bend line 95.

Fourth Modified, first Series Rigid Connector

Figure 46:
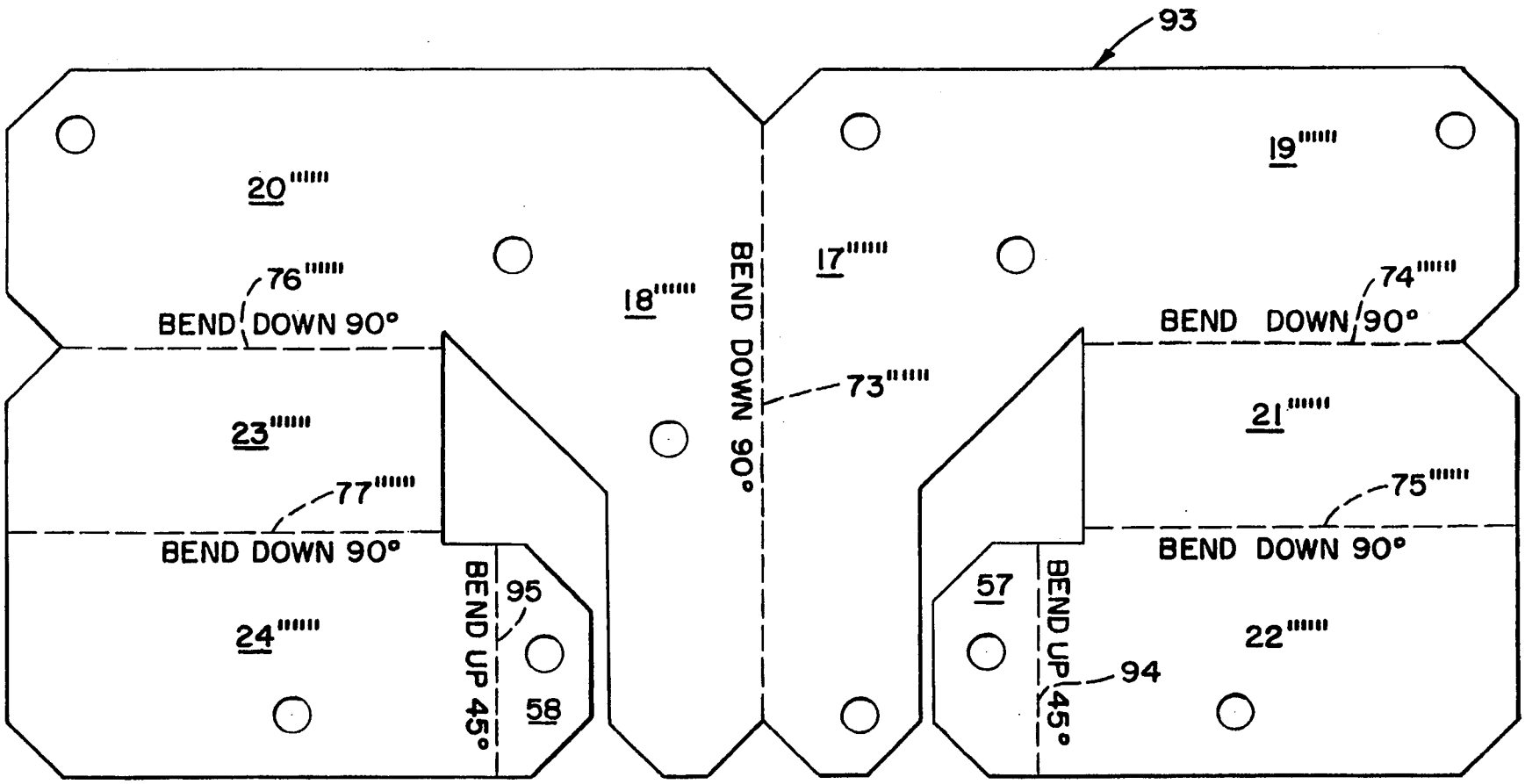
FIG. 46 is a top plan view of a sheet metal blank used in the construction of either the fourth modified second series rigid connector illustrated in FIG. 39 or the first series rigid connector illustrated in FIG. 42.
Figure 47:
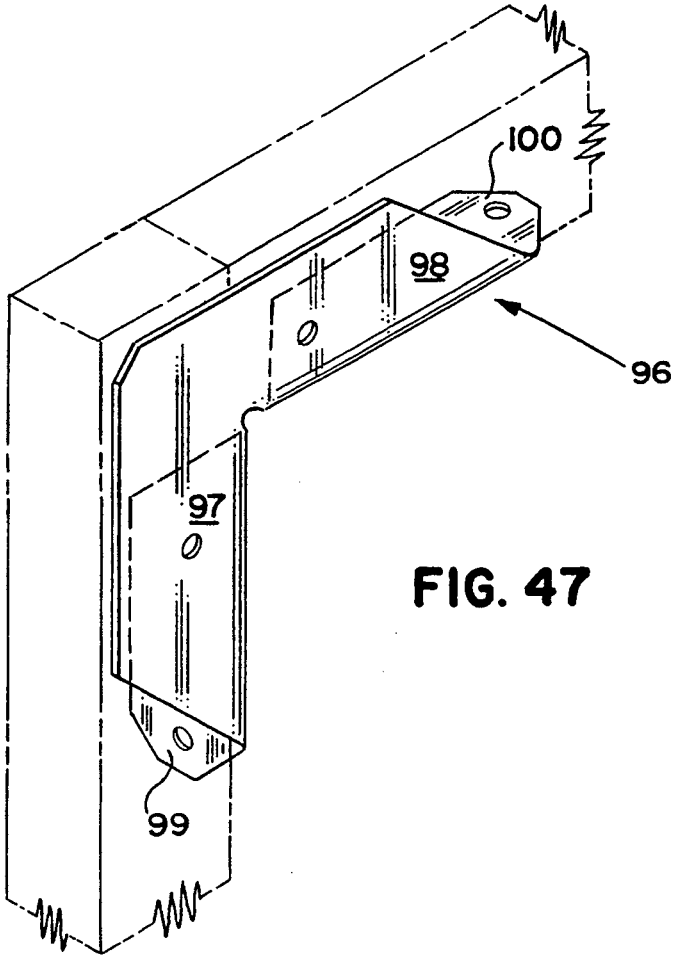
FIG. 47 is a perspective view of an angle used in the construction of the structures of the present invention.
Figure 48:
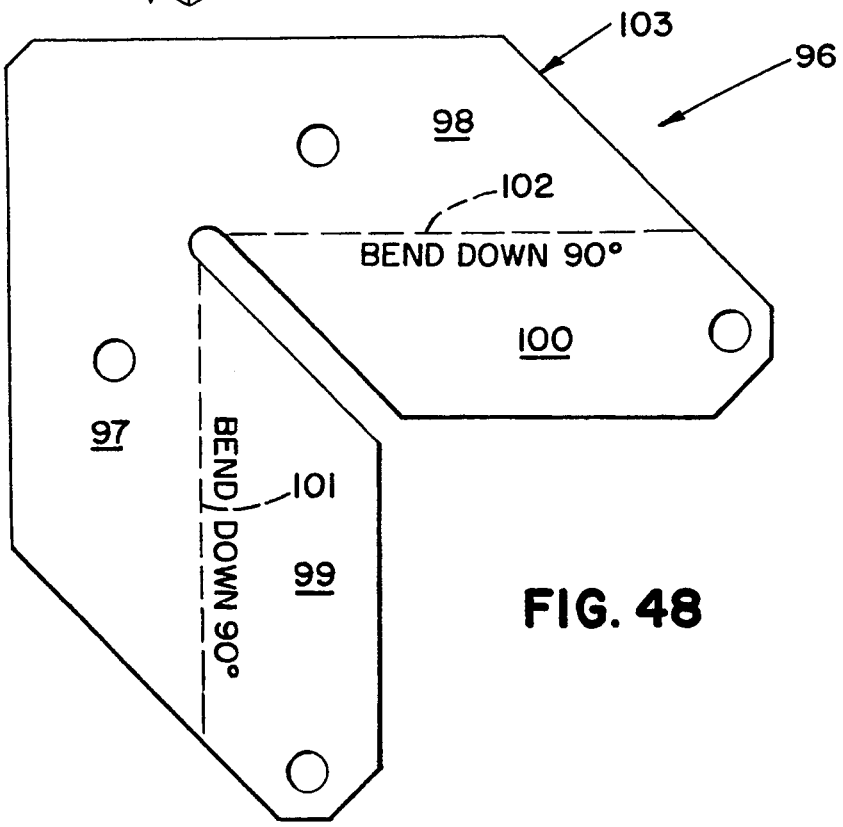
FIG. 48 is a sheet metal blank from which the angle illustrated in FIG. 47 is constructed.
Figure 49:
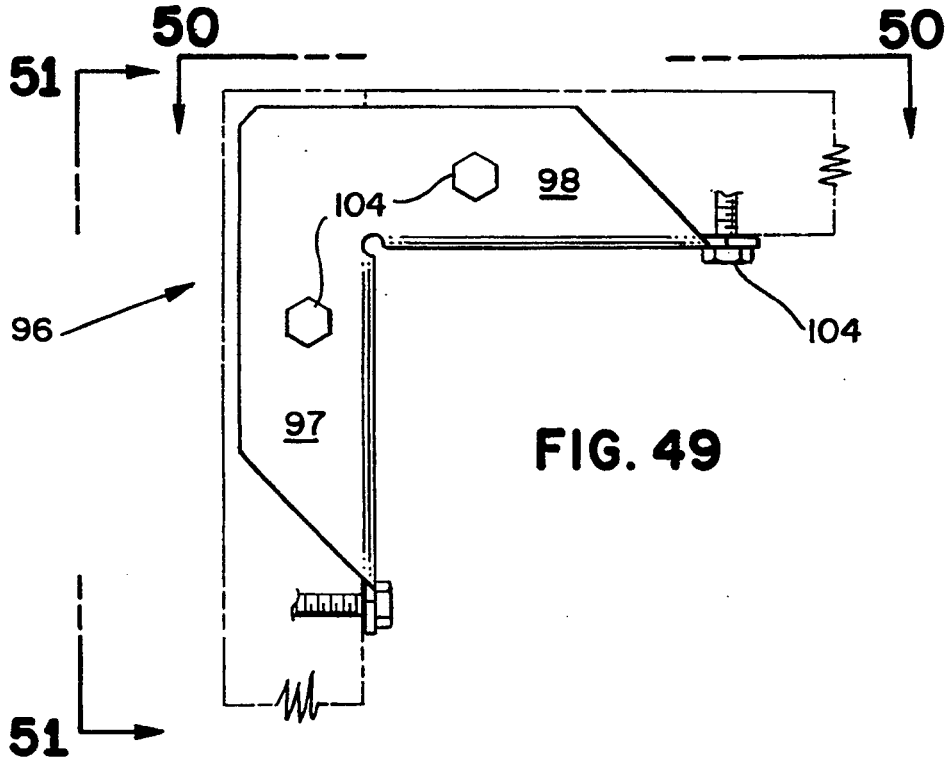
FIG. 49 is a side view of the angle illustrated in FIG. 47.
Figure 50:
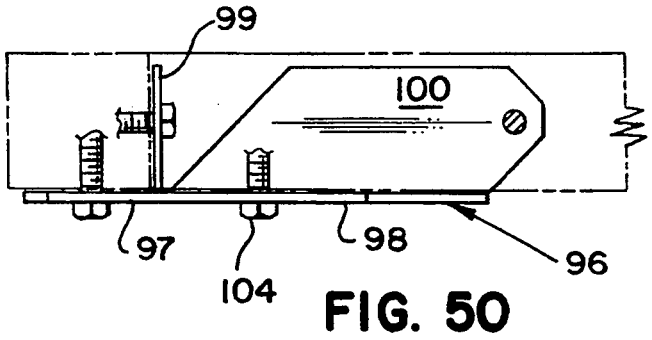
FIG. 50 is a top plan view of the angle illustrated in FIG. 49 taken generally;along line 50—50.
Figure 51:
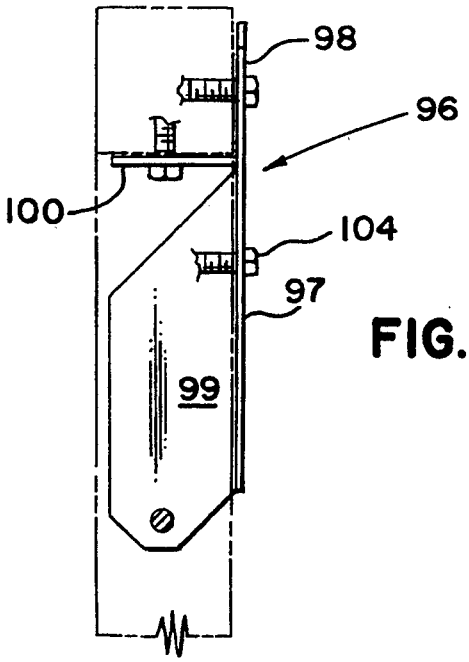
FIG. 51 is a side elevation view of the angle illustrated in FIG. 49 taken generally along line 51—51.

Fourth modified, first series rigid connector 15''''''' as illustrated in FIGS. 42–45 is constructed from sheet metal blank 93 illustrated in FIG. 46 in the exact same manner as fourth modified, second series rigid connector 15'''''' explained above except that no bend is made along bend line 73'''''' nor is any bend made along bend lines 94 and 95.

The description of fourth modified, first series rigid connector 15''''''' as illustrated in FIGS. 42–45 is identical to the description of fourth modified, second series rigid connector 15'''''' illustrated in FIGS. 39–41 except for the absence of bending along bend line 73'''''', and bend lines 57 and 58. Numbering of rigid intersection connection 1''''''' in FIGS. 42–45 is identical to the numbering of rigid intersection connection 1'''''' in FIGS. 39–41 except that the designation (''''''') is set forth after the numbers in FIGS. 42–45 instead of the designation (''''''') set forth after the numbers in FIGS. 39–41.

Rigid intersection connections 1'''''' and 1''''''' are used in the construction of the furniture structure 68 sometimes referred to as the "bunk bed" in FIGS. 36–38.

Rigid Angle

Referring to FIGS. 47–51, a rigid angle 96 is illustrated which is ancillary to the structures of the present invention based on rectangles rather than triangles. The rigid angle 96 consists of a first side 97, connected at right angles to a second side 98 and formed with a first member 99 integrally connected to first side 97 along bend line 101 and a second member 100 integrally connected to second side 98 along bend line 102 and constructed from a sheet metal blank 103 illustrated in FIG. 48. Attachment in furniture products is preferably by screws or lag bolts 104.

Construction of Building structure (greenhouse)

Construction of the building structure 69 such as a greenhouse illustrated in FIGS. 3–14 is generally as set forth above, but with the following additional description.

A plurality of intermediate elongated wood X structural members $2^9$ are attached at their bottom ends to elongated wood Y structural members $7^1$ and $7^2$ at spaced intervals by a plurality of first series rigid connectors 15' and at their top ends to sixth and seventh elongated X structural members $2^6$ and $2^7$ by third series rigid connectors 15''.

A door 105 may be hung in door frame members 106 and 107 in which their bottom ends are attached to first elongated wood Z structural member $11^1$ by first series rigid connectors 15' and their top ends by rigid angles 96.

In addition to the roof structure previously described, a plurality of intermediate rafters or intermediate elongated wood Z structural members $11^7$ and intermediate elongated wood Y structural members $7^7$ may be spaced at intervals with their lower ends connected to sixth and seventh elongated wood X structural members $2^6$ and $2^7$ by third series rigid connectors 15'' and their top ends connected to eighth elongated wood X structural member $2^8$ by second series rigid connectors 15.

A movable roof vent 109 may be located in the roof structure. Preferably the movable roof vent is controlled for opening and closing by a temperature sensitive means so that a more even temperature may be maintained in the greenhouse.

Movable roof vent 109 may be framed by framing member 112. Preferably movable lower side vent 108 is also installed in the side or rear of the greenhouse 69 to admit cool fresh air when needed.

An alternate form of construction is illustrated in FIGS. 8, 12, 13 and 14. The rear elevation of the building structure illustrated in FIG. 8 may be constructed with a window 114 set in window frames 113 and a movable vent 115 installed below window 114.

To strengthen the building structure, fire stops 116 may be installed as required and connected to the wood members by either first series rigid connectors 15' or second series rigid connectors 15 as required.

Door 105 may be one piece or it may be a two piece "dutch door" divided into upper and lower portions 110 and 111.

Construction of furniture structure (bunk bed)

A basic version of furniture structure 68, also known as a bunk bed was previously described. FIG. 36 illustrates a more commercial form having ladder means 119 including an intermediate elongated wood structural member $2^{10}$ connected at its upper end to third elongated wood Y structural member $7^3$ by first series rigid connector 15' and including a plurality of ladder steps 120. Railings 121 may be connected to the upper ends of elongated wood X structural members $2^1$, $2^2$, $2^3$, $2^4$, and $2^{10}$ by rigid angles 96, first series rigid connectors 15', and second series rigid connectors 15 as required. Load ledgers 122 may be added to support the edges of the bed frame, book shelves, desks and other loads to be held by the furniture structure. First elongated wood Y structural member $7^1$ may be removably attached to fifth rigid connector $15^{4''''''}$ and rigid angle 96 for ease in entering and exiting the furniture structure.

Construction of Bed and study unit

Research has indicated that college students assigned to small dormitory rooms or renting private rooms have very limited floor area in which to place their bed, desk and book storage unit. A combination bed and study unit illustrated 123 in FIGS. 37 and 38 using the rigid connectors previously described in this application was the structure which resulted from this study. The combination bed and study unit includes: a desk unit 117 connected to the first and second elongated wood X structural members $2^1$ and $2^2$; a storage unit 118 connected to the third and fourth elongated wood X structural members $2^3$ and $2^4$; ladder means 119 connected to the third and fourth elongated wood and structural members $2^{10}$; and the fastener means 55 are threaded for installation and disassembly of the rigid connectors 15, and 15', rigid angles 96, and elongated wood structural members as set forth in FIGS. 36–38 of the drawings. For purposes of clarity and convenience, no connectors were drawn on FIGS. 37 and 38. It is to be understood that the same connectors illustrated on FIG. 36 are used in the construction of the bed and study units illustrated in FIGS. 37 and 38.

I claim:

1. A rigid intersection connection in a structure:

a. a first elongated wood X structural member having first, second, third, and fourth sides;

b. a first elongated wood Y structural member intersecting said elongated wood X structural member and having first, seat and second sides;

c. a first elongated wood Z structural member intersecting said elongated wood X and Y structural members and having first, seat and second sides;

d. a first rigid connector constructed from a single sheet of sheet metal configured for holding said intersecting elongated wood X, Y, and Z structural members in a rigid embrace having:

(1). an XY support side member dimensioned for registration with a portion of said first side of said elongated wood X structural member;

(2). an XZ support side member disposed at an angle to said XY support side member and integrally connected thereto along a substantial portion thereof and dimensioned for registration with said second side of said elongated wood X structural member;

(3). a YX side member integrally connected to said XY support side member and dimensioned for registration with a portion of said first side of said elongated wood Y structural member;

(4). said XY support side member and said YX side member forming a first angle;

(5). a ZX side member integrally connected to said XZ support side member and dimensioned for registration with a portion of said first side of said elongated wood Z structural member;

(6). said XZ support side member and said ZX side member forming a second angle;

(7). a Y seat member integrally connected to said YX side member and dimensioned for registration with a portion of said seat side of said elongated wood Y structural member;

(8). a Y side member integrally connected to said Y seat member and dimensioned for registration with a portion of said second side of said elongated wood Y structural member;

(9). a Z seat member integrally connected to said ZX side member and dimensioned for registration with a portion of said seat side of said elongated wood Z structural member;

(10). a Z side member integrally connected to said Z seat member and dimensioned for registration with a portion of said second side of said elongated wood Z structural member;

e. first fastener means attaching said XY support side member to said first side of said elongated wood X structural member;

f. second fastener means attaching said YX side member said first side of said elongated wood Y structural member;

g. third fastener means attaching said Y side member the said second side of said elongated wood Y structural member;

h. fourth fastener means attaching said ZX side member to said first side of said elongated wood Z structural member;

i. fifth fastener means attaching said Z side member to said second side of said elongated wood Z structural member;

j. sixth fastener means attaching said XZ support side member to said second side of said elongated wood X structural member;

k. a Y side member extension X structural member interlock integrally connected to said Y side member at an angle and disposed for registration with said Z side member;

l. a restricted opening formed in said Y side member extension X structural member interlock;

m. a restricted slot opening formed in said Z side member in registration with said restricted opening formed in said Y side member extension X structural member interlock; and n. seventh fastener means dimensioned for insertion through said restricted opening formed in said Y side member extension X structural member interlock and said restricted slot opening formed in said Z side member, and inserted into said elongated wood X structural member.

* * * * *